US007905187B2

(12) United States Patent
Card et al.

(10) Patent No.: US 7,905,187 B2
(45) **Date of Patent: *Mar. 15, 2011**

(54) YARN FEED SYSTEM FOR TUFTING MACHINES

(75) Inventors: Roy T. Card, Chattanooga, TN (US); William M. Christman, Jr., Hixon, TN (US); Sherman W. Smith, II, Ringgold, GA (US)

(73) Assignee: Card-Monroe Corp., Hixson, TN (US)

( * ) Notice: Subject to any disclaimer, the term of this patent is extended or adjusted under 35 U.S.C. 154(b) by 1252 days.

This patent is subject to a terminal disclaimer.

(21) Appl. No.: 11/456,403

(22) Filed: Jul. 10, 2006

(65) Prior Publication Data

US 2006/0272564 A1 Dec. 7, 2006

Related U.S. Application Data

(63) Continuation of application No. 11/122,865, filed on May 5, 2005, now Pat. No. 7,096,806, which is a continuation of application No. 10/973,681, filed on Oct. 26, 2004, now Pat. No. 6,945,183, which is a continuation of application No. 10/634,208, filed on Aug. 5, 2003, now Pat. No. 6,834,601, which is a continuation-in-part of application No. 10/189,856, filed on Jul. 3, 2002, now Pat. No. 6,807,917.

(60) Provisional application No. 60/433,656, filed on Dec. 18, 2002.

(51) Int. Cl.
*D05C 15/16* (2006.01)

(52) U.S. Cl. ..... 112/80.7; 112/80.23; 700/136

(58) Field of Classification Search ..... 112/80.01, 112/80.23, 80.7, 80.73, 220, 302, 475.23; 700/131, 136–138
See application file for complete search history.

(56) References Cited

U.S. PATENT DOCUMENTS

| | | | |
|---|---|---|---|
| 2,842,259 | A | 7/1958 | Hoeselbarth |
| 2,862,465 | A | 12/1958 | Card |
| 2,866,424 | A | 12/1958 | Masland, II |
| 2,884,881 | A | 5/1959 | Oberholtzer |
| 2,932,181 | A | 4/1960 | MacCaffray, Jr. |

(Continued)

FOREIGN PATENT DOCUMENTS

| | | |
|---|---|---|
| GB | 1363974 | 7/1972 |

(Continued)

OTHER PUBLICATIONS

Super Graphics Product Brochure, Tuftco Corporation, Chattanooga, TN.

(Continued)

*Primary Examiner* — Gary L Welch
*Assistant Examiner* — Nathan E Durham
(74) *Attorney, Agent, or Firm* — Womble Carlyle Sandridge & Rice, PLLC

(57) ABSTRACT

A yarn feed system, enabling the control of individual yarns to the needles of a tufting machine, and which system can be manufactured as a substantially standardized unit or attachment that can be removably mounted to a tufting machine. The yarn feed unit includes a series of yarn feed devices for feeding each of the yarns to the needles of the tufting machine, and a series of yarn feed controllers that monitor and control the operation of the yarn feed devices to control the feeding of the yarns to the needles according to programmed pattern instructions.

6 Claims, 13 Drawing Sheets

U.S. PATENT DOCUMENTS

| | | | |
|---|---|---|---|
| 2,966,866 | A | 1/1961 | Card |
| 3,067,701 | A | 12/1962 | Wilcox |
| 3,075,482 | A | 1/1963 | Card |
| 3,095,840 | A | 7/1963 | Ballard |
| 3,095,841 | A | 7/1963 | Ballard et al. |
| 3,103,903 | A | 9/1963 | Broadrick et al. |
| 3,112,721 | A | 12/1963 | Oberholtzer et al. |
| 3,221,683 | A | 12/1965 | Abelsma |
| 3,605,660 | A | 9/1971 | Short |
| 3,752,094 | A | 8/1973 | Short |
| 3,847,098 | A | 11/1974 | Hammel, Jr. |
| 3,895,355 | A | 7/1975 | Shorrock |
| 3,906,876 | A | 9/1975 | Fitton |
| 3,943,865 | A | 3/1976 | Short et al. |
| 4,127,078 | A | 11/1978 | Spanel et al. |
| 4,193,358 | A | 3/1980 | Woodcock |
| 4,221,317 | A | 9/1980 | Fukada et al. |
| 4,244,309 | A | 1/1981 | Spanel et al. |
| 4,245,794 | A | 1/1981 | Hasegawa et al. |
| 4,267,787 | A | 5/1981 | Fukuda |
| 4,285,285 | A | 8/1981 | Chambers et al. |
| 4,317,419 | A | 3/1982 | Spanel et al. |
| 4,366,761 | A | 1/1983 | Card |
| 4,393,793 | A | 7/1983 | Beasley |
| 4,469,037 | A | 9/1984 | Bost, Jr. |
| 4,519,332 | A | 5/1985 | Fukuda |
| 4,549,496 | A | 10/1985 | Kile |
| 4,608,935 | A | 9/1986 | Bardsley |
| 4,619,212 | A | 10/1986 | Card et al. |
| 4,688,497 | A | 8/1987 | Card et al. |
| 4,829,917 | A | 5/1989 | Morgante et al. |
| 4,856,104 | A | 8/1989 | Stoll et al. |
| 4,856,441 | A | 8/1989 | Kurata |
| 4,864,946 | A | 9/1989 | Watkins |
| 4,867,080 | A | 9/1989 | Taylor et al. |
| 4,870,915 | A | 10/1989 | Bagnall |
| 4,981,091 | A | 1/1991 | Taylor et al. |
| 5,005,498 | A | 4/1991 | Taylor et al. |
| 5,058,518 | A | 10/1991 | Card et al. |
| 5,080,028 | A | 1/1992 | Ingram |
| 5,094,178 | A | 3/1992 | Watkins |
| 5,182,997 | A | 2/1993 | Bardsley |
| 5,205,233 | A | 4/1993 | Ingram |
| 5,285,821 | A | 2/1994 | Fredricksson |
| 5,353,582 | A | 10/1994 | Citterio et al. |
| 5,383,415 | A | 1/1995 | Padgett, III |
| 5,458,075 | A | 10/1995 | Tice et al. |
| 5,461,996 | A | 10/1995 | Kaju |
| 5,526,760 | A | 6/1996 | Ok |
| 5,544,064 | A | 8/1996 | Beckwith |
| 5,544,605 | A | 8/1996 | Frost |
| 5,549,064 | A | 8/1996 | Padgett, III |
| 5,575,228 | A | 11/1996 | Padgett, III et al. |
| 5,588,383 | A | 12/1996 | Davis et al. |
| 5,622,126 | A | 4/1997 | Card et al. |
| 5,662,054 | A | 9/1997 | Bardsley |
| 5,738,030 | A | 4/1998 | Ok |
| 5,743,200 | A | 4/1998 | Miller et al. |
| 5,743,201 | A | 4/1998 | Card et al. |
| 5,794,551 | A | 8/1998 | Morrison et al. |
| 5,806,446 | A | 9/1998 | Morrison et al. |
| 5,983,815 | A | 11/1999 | Card |
| 6,009,818 | A | 1/2000 | Cant et al. |
| 6,213,036 | B1 | 4/2001 | Slattery |
| 6,244,203 | B1 | 6/2001 | Morgante et al. |
| 6,283,053 | B1 | 9/2001 | Morgante et al. |
| 6,439,141 | B2 | 8/2002 | Morgante et al. |
| 6,516,734 | B1 | 2/2003 | Morgante et al. |
| 6,550,407 | B1 | 4/2003 | Frost et al. |
| 6,807,917 | B1 | 10/2004 | Christman et al. |
| 6,834,601 | B2 | 12/2004 | Card et al. |
| 6,877,449 | B2 | 4/2005 | Morgante et al. |
| 2002/0037388 | A1 | 3/2002 | Morgante et al. |

FOREIGN PATENT DOCUMENTS

| | | |
|---|---|---|
| GB | 2002828 | 7/1978 |
| GB | 2002040 | 2/1979 |
| GB | 2186297 | 7/1987 |

OTHER PUBLICATIONS

CAM with Encore DMC Operator's Manual, Tuftco Corporation, Chattanooga, TN, 1996.
CP2100 Series Yarn Feed/Shift Compensation System Product Brochure, Card-Monroe Corp, Chattanooga, TN.
Tuft Program, Versin 1.20, NedGraphics.
Command Performance 2002 Instruction Manual, Version 3.12, Card-Monroe Corp. Chattanooga, TN.
Tufting Machine Schematic, Card-Monroe Corp., Chattanooga, TN.
CMC Yarntronics Brochure, Card-Monroe Corp., Chattanooga, TN.
Scroll Graphics for One and Only Pattern Brochure, Tuftco Corp., Chattanooga, TN.
Encore Computer Controlled Tufting and Management Information System Brochure, Tuftco Corp., Chattanooga, TN.
MTInnovation Brochure, Modern Techniques, Inc., Ringgold, Georgia.
Zieseniss Tufting Machine Operational Manual.
Cobble Tufting Machines, L.P. Scroll, 1985/1986.
LPIII Low Profile Scroll by Cobble, 1985/1986.
Tuftco Corporation Split Rainbow Pattern System Brochure.
Tuftco Corporation Multi-Media PC-Control System Brochure.
"Automation Comes to Paris," Carpet & Rug, 1987.
"Carpet Manufacturing Represented at Textile Machinery Exhibition," Carpet Manufacturer International ITMA 87 Preview, Aug. 1987.
Encore DMC Digital Motor Control System Brochure, Tuftco Corporation, Chattanooga, TN.
Tuftco "Encore" Yarn Feed Control Brochure, Tuftco Corporation, Chattanooga, TN.
Cobble Blackburn Limited Order and Contract, Jan. 1986.
Galil Controllers Help Modern Techniques Computerize Carpet Industry Brochure, Galil Motion Control, Inc., Mountain View, CA.

YARN FEED SYSTEM FOR TUFTING MACHINES

CROSS-REFERENCE WITH RELATED APPLICATIONS

The present application is a continuation of U.S. patent application Ser. No. 11/122,865, filed May 5, 2005; now U.S. Pat. No. 7,096,806 which is a continuation of U.S. patent application Ser. No. 10/973,681, filed Oct. 26, 2004, now U.S. Pat. No. 6,945,183; which is a continuation of U.S. patent application Ser. No. 10/634,208, filed Aug. 5, 2003, now U.S. Pat. No. 6,834,601; which is a continuation-in-part of U.S. patent application Ser. No. 10/189,856, filed Jul. 3, 2002, now U.S. Pat. No. 6,807,917, and further claims priority to U.S. Provisional Application Ser. No. 60/433,656, filed Dec. 18, 2002.

FIELD OF THE INVENTION

The present invention generally relates to carpet tufting machines and in particular to a yarn feed system or pattern attachment for controlling the feeding of individual yarns to the needles of a tufting machine.

BACKGROUND OF THE INVENTION

In the carpet-tufting field, there is considerable emphasis placed on developing new, eye-catching carpet patterns to keep up with changing consumer tastes and increased competition in the marketplace. With the introduction of computer controls for tufting machines, as disclosed in U.S. Pat. No. 4,867,080, greater precision and variety in designing and producing tufted patterned carpets has been possible while also enabling enhanced production speeds. In addition, computerized design centers have been developed, such as shown in U.S. Pat. No. 5,058,518, to enable designers to design and develop visual representations of patterns on a computer and generate the pattern requirements such a yarn feed, pile heights, etc. that will be input into a tufting machine controller for forming such patterns.

Traditionally, pattern attachments such as roll or scroll pattern attachments have been used for controlling the feeding of selected groups of yarns to the needles of a tufting machine having such a pattern attachment. Such roll and/or scroll pattern attachments include a series of yarn feed rolls that feed the selected groups of yarns to selected ones of the needles. By controlling the operation of these feed rolls, the rate of feed of the yarns to the needles is controlled for varying the pile heights of the tufts of yarn formed in a backing material passing through the tufting machine, so as to enable some tufts of yarn to be back-robbed and hidden by adjacent tufts in order to form different pattern repeats across the width of the backing material.

A significant problem, however, that exists with the use of such traditional pattern attachments and even with more recently developed scroll type pattern attachments such as disclosed in U.S. Pat. No. 6,244,203, which discloses a servomotor controlled scroll type pattern attachment for a tufting machine, has been the requirement for tube banks that extend from the pattern attachment feed rolls at varying lengths across the tufting machine for feeding the yarns from the pattern attachment feed rolls to the needles. Such tube banks include a plurality of tubes of varying lengths, along which the yarns are urged or fed to their respective needles. The problem with such tube banks generally has been that the yarns passing through the longer tubes are typically subjected to increased drag or friction as they are passed along the increased length of their tubes, such that it has been difficult to achieve high amounts of precision and responsiveness to changes in the pattern across the width of the carpet. The use of the tube banks further adds a significant cost both in terms of manufacture and set up of the machines, as well as significantly increasing the complexity of operation of the tufting machines.

In addition, systems such as disclosed in U.S. Pat. Nos. 6,244,203 and 6,213,036 have attempted to achieve greater precision and control of the feeding of the yarns by the pattern attachment through the use of an increased number of feed rolls and drive motors for feeding selected ones of the yarns to selected needles. However, as the number of yarn feed rolls and number of motors associated therewith for driving such individual yarn feed rolls is increased, there is likewise a corresponding increase in the costs of such pattern attachments. In addition, increasing the number of motors and feed rolls further increases the complexity of manufacturing such pattern attachments, as well as the set up of such attachments as a part of a tufting machine when the machine is installed in the field. In addition, the reliability of such systems generally becomes of greater concern, given the increased number of feed devices being controlled by the tufting machine controller and the corresponding amount of wiring and electrical connections that must be assembled and made in the field with the set up of the tufting machine and pattern attachments.

Accordingly, it can be seen that a need exists for a system that addresses these and other related and unrelated problems in the art.

SUMMARY OF THE INVENTION

Briefly described, the present invention generally relates to a yarn feed system or pattern yarn feed attachment that is removably mounted on a tufting machine and is adapted to feed a series of yarns individually to each of the needles of the tufting machine. The feeding of the individual yarns to each needle is independently controlled by the yarn feed system to provide enhanced precision and control as needed or desired to form tufts of yarn in a backing material being passed through the tufting machine according to programmed carpet pattern instructions. The yarn feed system of the present invention generally comprises a yarn feed unit that can be constructed as a standardized, self-contained unit or attachment that can be releasably mounted to and/or removed from the tufting machine as a unit, and enables multiple yarn feed units to be mounted to the tufting machine in series as needed depending on the number of needles in the tufting machine.

The yarn feed unit of the present invention generally includes a frame defining a housing in which a series of yarn feed devices are received and supported. Each of the yarn feed devices generally includes a drive motor that can be releasably mounted within the frame and drives a drive roll, and an idler roll that is biased toward engagement with the drive roll to engage a yarn therebetween. A series of yarn feed tubes feed individual yarns from a yarn supply to each of the yarn feed devices, with the yarns being engaged and guided between the drive and idler rolls of their associated yarn feed devices. The drive motors of the yarn feed devices are independently controlled so as to feed the yarns at desired rates to selected ones of the needles of the tufting machine.

A series of yarn feed controllers or multiple drive units are received and mounted within a cage or support mounted within the housing of the yarn feed unit. Each of the yarn feed controllers generally includes a controller board or module, and typically will have a primary control processor mounted on the board and a series of motor controllers or drives each connected to the primary control processor. A secondary control processor further can be provided to provide for backup and redundancy for each yarn feed controller to increase or enhance reliability thereof. Each of the motor controllers generally controls at least one of the drive motors of the yarn feed devices in accordance with control instructions provided by the primary and/or secondary control processors. The motor controllers also provide feedback to the control processor(s) regarding the operation of the drive motors being controlled by each motor controller.

The control processors of each of the yarn feed controllers further are electrically connected to a system control unit or controller, which monitors the feedback from the motor controllers, and provides pattern control instructions to the control processor(s) of each of the yarn feed controllers. These instructions are in turn communicated to the motor controllers for controlling the speed of each of the drive motors to individually control the feeding of each yarn to its corresponding needle to form the desired or programmed pattern. The system controller can be provided as a separate workstation having an input mechanism, such as a keyboard, mouse, etc. and a monitor and generally will be in communication with a tufting machine controller that monitors various operative elements of the tufting machine. Alternatively, the system controller and/or its functions can be included as part of the tufting machine controller.

In addition, the system controller can be connected to a design center on which an operator can design a desired carpet patterns and which generally includes a computer that will calculate the parameters of such a design, including parameters including yarn feed rates, pile heights, stitch length, etc. This information can be created as a pattern data file, designed or programmed using pattern design software or a design system and input or electronically communicated to the tufting machine controller and/or the system controller of the yarn feed unit via a network connection, disk or other file transfer. Alternatively, the tufting machine controller or the system controller can be provided with the design center components or functionality programmed therein so as to enable the operator to design or program carpet patterns at the tufting machine.

The yarn feed unit of the present invention thus provides individualized control of the feeding of each of a series of yarns to each of the needles of the tufting machine according to programmed pattern instructions to form a desired pattern. The yarn feed unit of the present invention further enables the manufacture of standardized yarn feed attachments or units that can be manufactured, tested, stored in inventory, and thereafter removably installed on a tufting machine without requiring the custom design and installation of such a pattern attachment, and without requiring a costly and time-consuming set-up of the machine and tube bank array therefor. In addition, the housing of the yarn feed unit can be formed with a substantially open design, and the yarn feed unit can include a series of fans and heat sinks being provided for the yarn feed controllers to promote the efficient dissipation of heat from the yarn feed unit for the efficient and reliable operation of the electronic components thereof.

Various features, objects and advantages of the present invention will become apparent to those skilled in the art upon reading the following detailed description when taken in conjunction with the accompanying drawings.

DETAILED DESCRIPTION OF THE INVENTION

Figure 1:
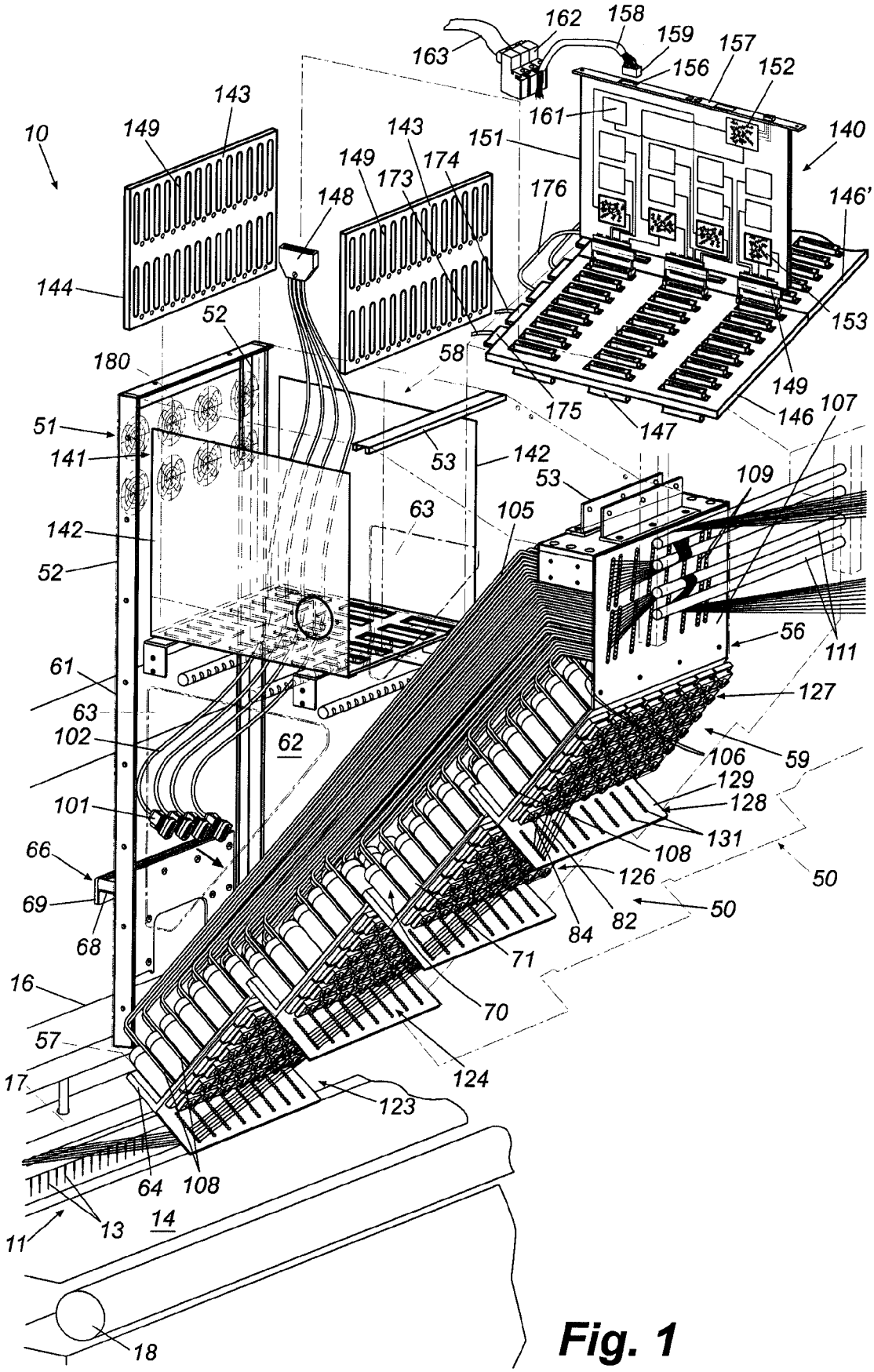
FIG. 1 is a perspective view with parts broken away illustrating the yarn feed system of the present invention.

Referring now in greater detail to the drawings in which like numerals indicate like parts throughout the several views, FIGS. 1-6 illustrate the yarn feed control system or yarn feed pattern attachment 10 of the present invention, which is releasably mountable to a tufting machine 11 (FIGS. 1, 2) for controlling the feeding of individual yarns 12 to the needles 13 of the tufting machine 11. The yarn feed system of the present invention enables the feeding of individual yarns to each needle to be independently controlled to enable greater precision and control in the formation of tufts of yarn in a backing material 14 passing through the tufting machine and beneath the needles 13 in order to form programmed or desired carpet patterns.

Figure 2:
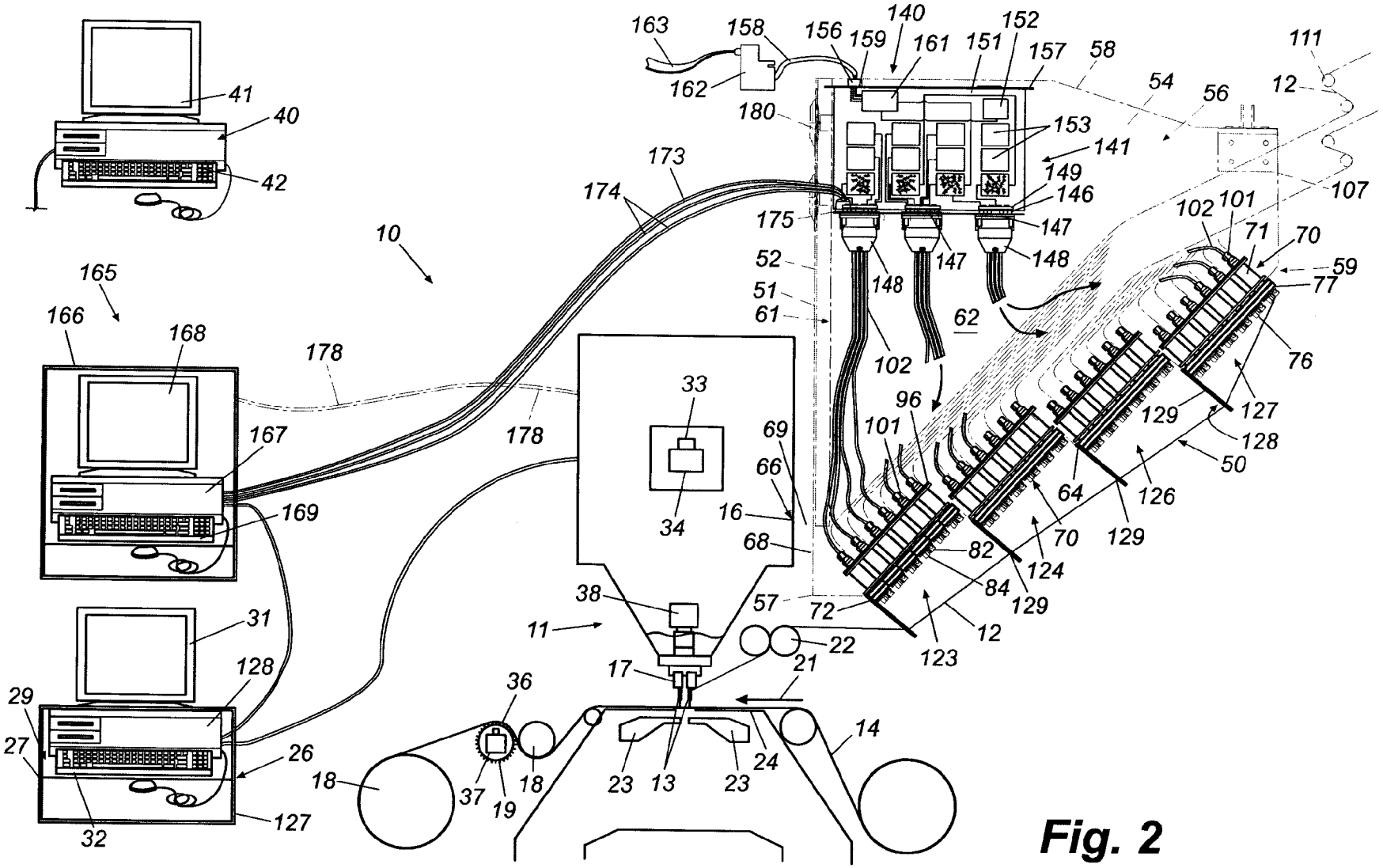
FIG. 2 is a side view schematically illustrating of the yarn feed system of the present invention mounted to a tufting machine.

As indicated in FIG. 2, the tufting machine 11 generally will comprise a conventional tufting machine such as disclosed in U.S. Pat. No. 5,979,344, having a frame 16 on which is supported a machine drive or main drive shaft (not shown) that reciprocally drives at least one reciprocating needle bar 17 carrying the needles 13 mounted in spaced series therealong, backing feed rolls 18, including a spike roll 19, for feeding the backing material 14 through a tufting zone defined beneath the needles 13 of the tufting machine in a direction of feed indicated by arrow 21, and puller rolls 22 for pulling and feeding the yarns directly to the needles 13. It will be understood that the present invention can be utilized on essentially any type of tufting machine 11, including machines having single and dual shiftable needle bars 17 that can be shiftable in a transverse direction, as well as machines having a single reciprocating needle bar with multiple in-line or staggered rows of needles mounted therealong. As the needle bars are reciprocated, the needles 13 are moved vertically between a raised position out of engagement with the backing material 14 passing therebeneath and a lowered, engaging position extending through the backing material and engaging a series of loopers 23 or hooks mounted beneath the bed plate 24 of the tufting machine for the formation of loops or tufts of yarn within the backing material.

As indicated in FIG. 2, the tufting machine 11 further generally includes a tufting machine controller or control unit 26, such as disclosed in U.S. Pat. No. 5,979,344, that monitors and controls the various operative elements of the tufting machine, such as the reciprocation of the needle bars, backing feed, shifting of the needle bars, bedplate position, etc. The machine controller 26 typically includes a cabinet or work station 27 housing a control computer or processor 28, and a user interface 29 that can include a monitor 31 and an input device 32, such as a keyboard, mouse, keypad, drawing tablet, or similar input device or system as would be recognized by those skilled in the art. In addition, the monitor 31 could be a touch screen type monitor to enable operator input to the tufting machine controller.

The tufting machine controller 26 generally will control and monitor feedback from various operative or drive elements of the tufting machine such as receiving feedback from a main shaft encoder 33 for controlling a main shaft drive motor 34 so as to control the reciprocation of the needles, and monitoring feedback from a backing feed encoder 36 for use in controlling the drive motor 37 for the backing feed rolls to control the stitch rate or feed rate for the backing material. A needle sensor or proximity switch (not shown) also can be mounted to the frame in a position to provide further position feedback regarding the needles. In addition, for shiftable needle bar tufting machines, the controller 26 further generally will monitor and control the operation of needle bar shifter mechanism(s) 38 (FIG. 2) for shifting the needle bars 17 according to programmed pattern instructions.

The tufting machine controller 26 generally will receive and store such programmed pattern instructions or information for a series of different carpet patterns. These pattern instructions can be stored as a data file in memory at the tufting machine controller itself for recall by an operator, or can be downloaded or otherwise input into the tufting machine controller by the means of a floppy disk or other recording medium, direct input by an operator at the tufting machine controller, or from a network server via network connection. In addition, the tufting machine controller can receive inputs directly from or through a network connection from a design center 40. The design center 40 (FIG. 2) can include a separate or stand-alone design center or work station computer 41 with monitor 42 and user input 43, such as a keyboard, drawing tablet, mouse, etc., through which an operator can design and create various tufted carpet patterns, as is known in the art. This design center also can be located with or at the tufting machine or can be much more remote from the tufting machine.

An operator can create a pattern data file and possibly graphic representations of the desired carpet pattern at the design center computer 41, which will calculate the various parameters required for tufting such a carpet pattern at the tufting machine, including calculating yarn feed rates, pile heights, backing feed or stitch rate, and other required parameters for tufting the pattern. These pattern data files typically then will be downloaded or transferred to the machine controller, to a floppy disk or similar recording medium, or can be stored in memory either at the design center or on a network server for later transfer and/or downloading to the tufting machine controller. Further, for machine located design centers and/or where the machine controller has design center functionality or components programmed therein, it is preferable, although not necessarily required, that the design center 40 and/or machine controller 26 be programmed with and use common Internet protocols (i.e., web browser, FTP, etc.) and have a modem, Internet, or network connections to enable remote access and trouble shooting.

As shown in FIGS. 1 and 2, the yarn feed system 10 of the present invention generally comprises a yarn feed unit or attachment 50 that can be constructed as a substantially standardized, self-contained unit or attachment capable of being releasably mounted to and removable from the tufting machine frame 16 as a one-piece unit or attachment. The present invention thus enables the manufacture of substantially standardized yarn-feed units capable of controlling the feeding of individual yarns to a predetermined number or set of needles of the tufting machine. As a result, instead of requiring that the yarn feed attachment or system of the present invention be constructed as a custom designed unit or system that is manufactured with the tufting machine, and then disassembled, transported, and reassembled again at a customer's plant or in the field, the present invention enables the construction of standardized, substantially uniform yarn feed units that can be manufactured, stored, and shipped independently from the tufting machines to which they are to be mounted. The yarn feed units of the present invention further can be mounted to a tufting machine as part of a new machine construction or as a retro-fit or conversion in the field, wherein a series of yarn feed units can be selected and removed from an inventory, depending upon the number of needles of the tufting machine, and mounted in series to the tufting machine.

As shown in FIGS. 1 and 2, the yarn feed unit 50 of the present invention generally includes a frame 51, including a pair of vertically extending support beams 52, cross-beams or braces 53, and side plates, indicated by phantom lines 54, so as to define a housing or cabinet 56. The housing 56 generally extends upwardly and outwardly from a lower end 57 to an upper end 58 that projects outwardly from the tufting machine frame 16 and lower end 57 of the housing so as to provide the yarn feed unit with a front face or side 59 that extends upwardly at an angle with respect to the rear face or side 61, so as to define an open interior region or space 62 as shown in FIGS. 1 and 2. The upper end 58 of the housing can be open or can include a cover, and side openings, such as indicated by phantom lines 63 in FIG. 1, can be formed in the side plates 54 so as to promote enhanced and efficient airflow through the yarn feed unit 50 and enable enhanced, rapid dissipation of heat from the operative elements of the yarn feed unit 50 to avoid overheating or damage to the electronic components of the yarn feed unit of the present invention. Step plates 64 further generally are mounted at spaced positions along the front face 59 of the yarn feed unit so as to define staggered, stepped or offset sections thereof.

As indicated in FIG. 1, one or more mounting brackets 66 can be attached to the vertical supports 52 of the frame 51 along the rear side 61 of the housing 56. The mounting brackets typically include a support plate or beam 67 attached at one end or side to the supports 52 and to a mounting angle plate 68 mounted at its other, opposite end. The mounting angle plate 68 generally is fastened to the frame 16 of the tufting machine 11 with fasteners such as bolts, screws or other removable fasteners, but also can be welded, riveted or otherwise fixed to the tufting machine frame as desired for more permanent mounting of the yarn feed unit to the tufting machine. Multiple mounting brackets also can be used for supporting the yarn feed unit of the present invention from a tufting machine, depending upon the size and/or configuration of the yarn feed unit.

Figure 3:
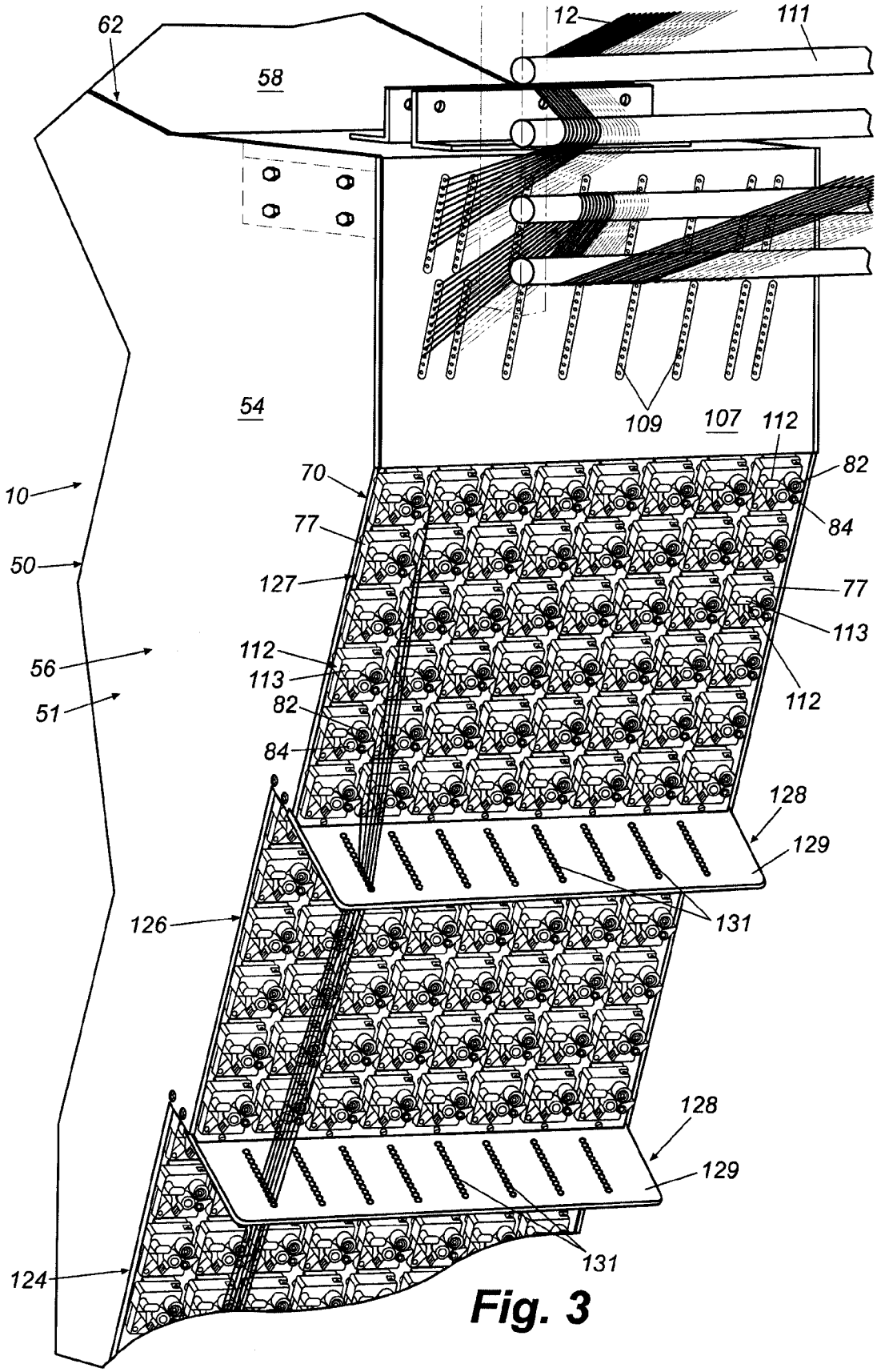
FIG. 3 is a perspective view of a portion of the yarn feed system of FIGS. 1 and 2 illustrating the feeding of yarns by the yarn feed devices of the present invention.

As indicated in FIGS. 1-3, the yarn feed unit 50 further includes a series of yarn feed devices 70 that are received and removably mounted within the housing 56 of the yarn feed unit. The yarn feed devices generally engage and feed individual yarns to associated needles of the tufting machine for individual or single end yarn feed control, although in some configurations, the yarn feed devices also can be used to feed multiple yarns to selected sets or groups of needles. For example, in a machine with 2,000 needles, each yarn feed unit could control two or more yarns such that 1,000 or fewer yarn feed units can be used to feed the yarns to the needles. The yarn feed unit typically will be provided with a pre-determined number or series of yarn feed devices that typically corresponds to some multiple of the needles of the tufting machine. For example, the yarn feed unit typically can be manufactured with about 192 yarn feed devices 70 removably mounted therein (although other configurations having greater or fewer yarn feed devices can also be used). The yarn feed units thus can be manufactured as substantially standardized attachments or units that can be manufactured and stored in inventory for use as needed, without requiring the custom manufacture and assembly of a yarn feed unit of the present invention with the construction of the tufting machine. Accordingly, when the pattern yarn feed attachment for tufting machines is required, a series of yarn feed units or attachments according to the present invention can be removed from inventory and mounted in series across the width of a tufting machine, with the number of yarn feed units selected dependent upon the number of needles of the tufting machine and the number of yarns being controlled by the yarn feed devices thereof.

Figure 4A:
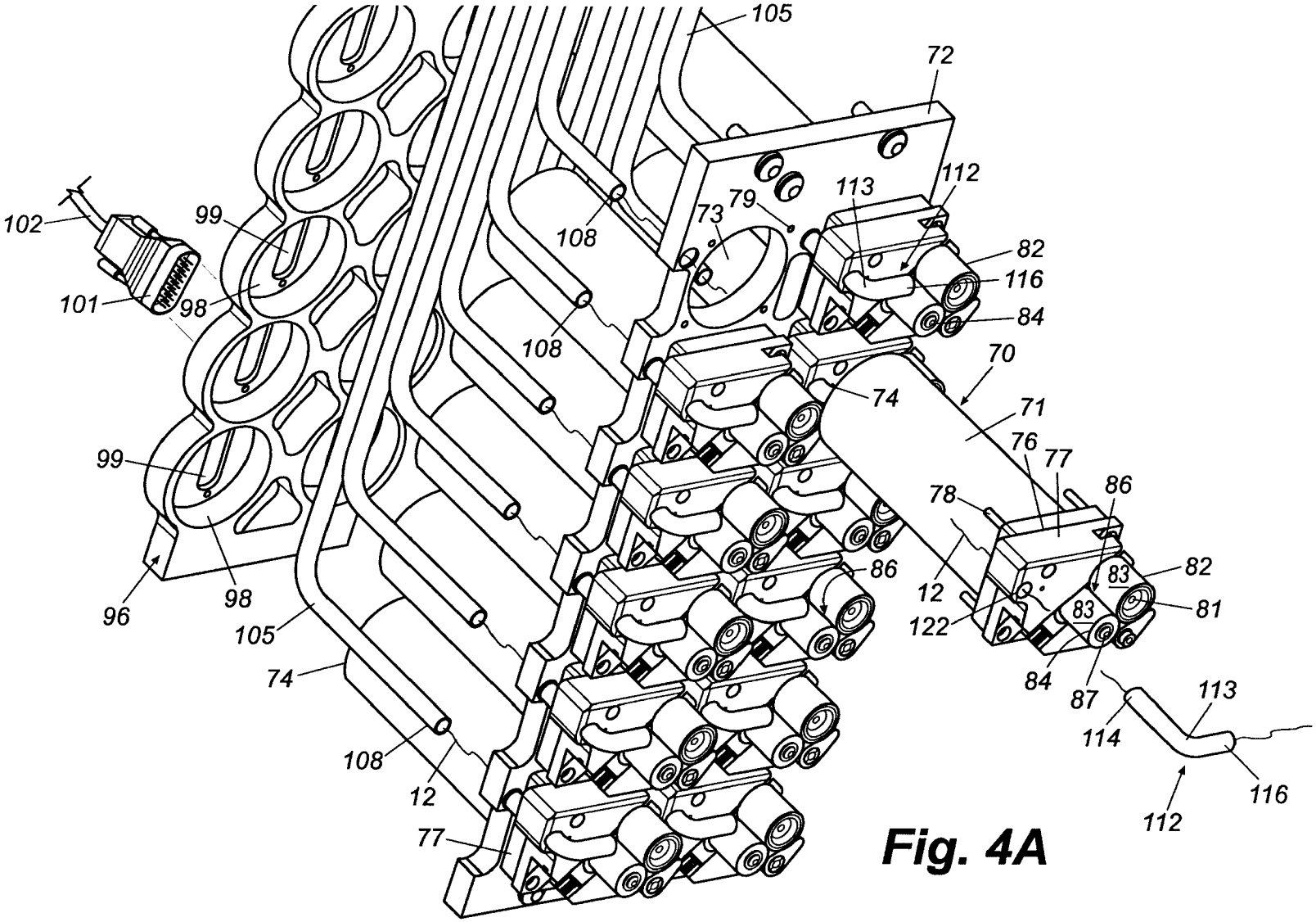
FIG. 4A is an exploded perspective view with parts broken away, of a portion of the yarn feed system illustrating the mounting of the yarn feed drive motors to each of the yarn feed devices within the frame of the yarn feed system.

As indicated in FIGS. 1 and 4A, each of the yarn feed devices 70 generally includes a drive motor 71 that is received or releasably mounted within a motor mounting plate 72, mounted to the frame 51 of the yarn feed unit 50 along the front face or side 59 of the housing 56. The motor mounting plates 72 include a series of openings or apertures 73 in which a drive motor 71 is received for mounting, as indicated in FIG. 4A.

Each of the yarn feed drive motors generally is a variable speed electric motor (i.e., about 0-1500 rpm, and typically about 300-800 rpm) of sufficient size and power to be able to pull at least approximately a 0-500±500 gram sine wave force, and generally sufficient to pull approximately 1000 grams or more of constant force on a yarn 12 being pulled and fed thereby. Preferably, the drive motors will have a motor power range of about 5 W to 25 W, sufficient to be able to provide yarn feed rates of up to 1500-1800 inches per minute. However, it will be also understood that a variety of different type variable speed electric motors can be used for the drive motors 71 of the yarn feed units in order to feed a range of yarn sizes (deniers) and materials that would or could be used in the tufting process, which motors are sufficiently compact in size for use in the yarn feed unit of the present invention. The drive motors also generally will be approximately 3-6 inches or less in length, with diameter or face size of approximately 2 inches, although larger or smaller sized motors can be used, depending upon the application or system requirements, and will include an internal encoder or similar feedback device for monitoring the position or speed of the motor. In addition, sine drive power stage motors generally will be used for enhanced efficiency of the system for factors such as heat (power) management at the motor drive electronics and power supplies.

The drive motors include distal or rear ends 74 (FIG. 4A) that are received through openings 73 and front or proximal ends 76 having a face plate 77 mounted thereto. Each face plate 77 generally is formed from a metal such as aluminum or other light weight, high strength material and is generally formed with a substantially square or rectangular configuration so as to overlap the openings 73 in the motor mounting plates 72 to limit the extent that the motors will pass through the motor mounting plates. A series of fasteners 78, such as bolts, screws, clips, or other similar removable fastening mechanisms, are extended through the faceplate 77 of each drive motor 71 and engage corresponding fastener openings or apertures 79 within the motor mounting plate 72 for releasably securing the drive motors thereto. The drive motors 71 (FIG. 5) each also include a drive shaft 81 on which a drive roll 82 is mounted so as to be driven by the operation of the drive motor. Each drive roll 82 (FIG. 4A) generally is formed with a gripping surface 83, which can also include the application of a gripping media, such as a rubberized coating, sandpaper, knurling, or similar roughened, tacky surface, or can include gearing that provides enhanced engagement and gripping of the yarn as the drive roll is rotated to avoid slippage of the yarns during feeding.

Figure 5:
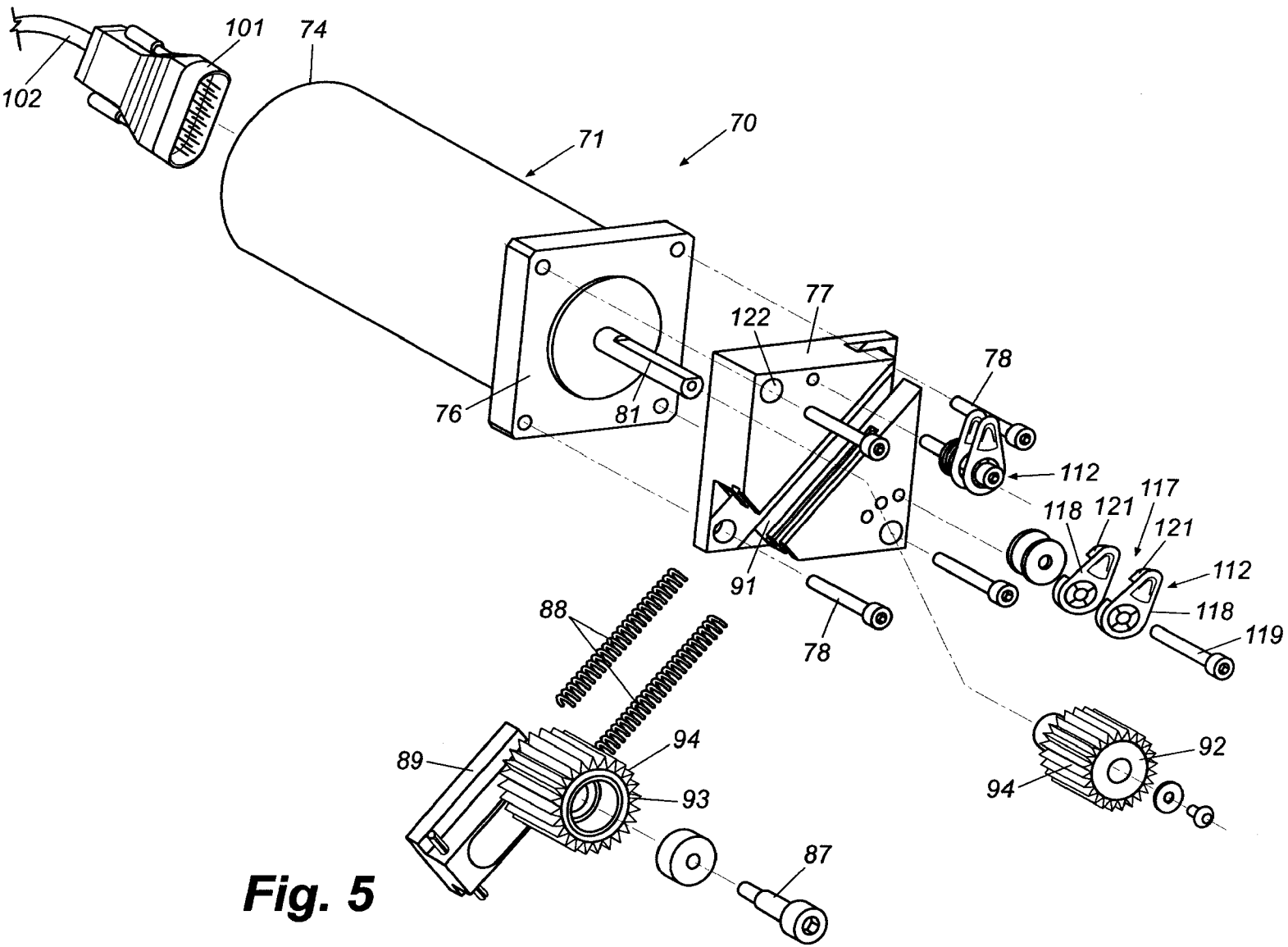
FIG. 5 is an exploded perspective view of an alternate embodiment of a yarn feed device of the present invention.

Idler rolls 84, typically having a similar gripping surface or media covering 83 applied thereto are biased toward engagement with each drive roll 82 so as to define a pinch area or region 86 at which the yarns 12 are engaged or pulled between each drive roll and its associated idler roll as indicated in FIG. 3. Each idler roll 84 generally is rotatably mounted on an idler shaft 87 so as to freely rotate with respect to its drive roll 82, and is biased into engaging contact with its drive roll by springs 88 as indicated in FIG. 5. As shown in FIG. 5, the idler roll is mounted on a carriage or slide 89 that is attached to the springs 88, which generally exert a pulling or tension force on the carriage so as to pull or urge the idler roll along slot 91 toward and into engagement with its associated drive roll. FIG. 5 further illustrates an alternative embodiment of the drive and idler rolls, here shown as gears or sprockets 82' and 84', with each having a series of radially projecting teeth 92 and 93 that engage and intermesh with one another so that the idler rolls are driven or rotated with the driving of the drive rolls and pull the yarns between the intermeshing teeth thereof.

Figure 7:
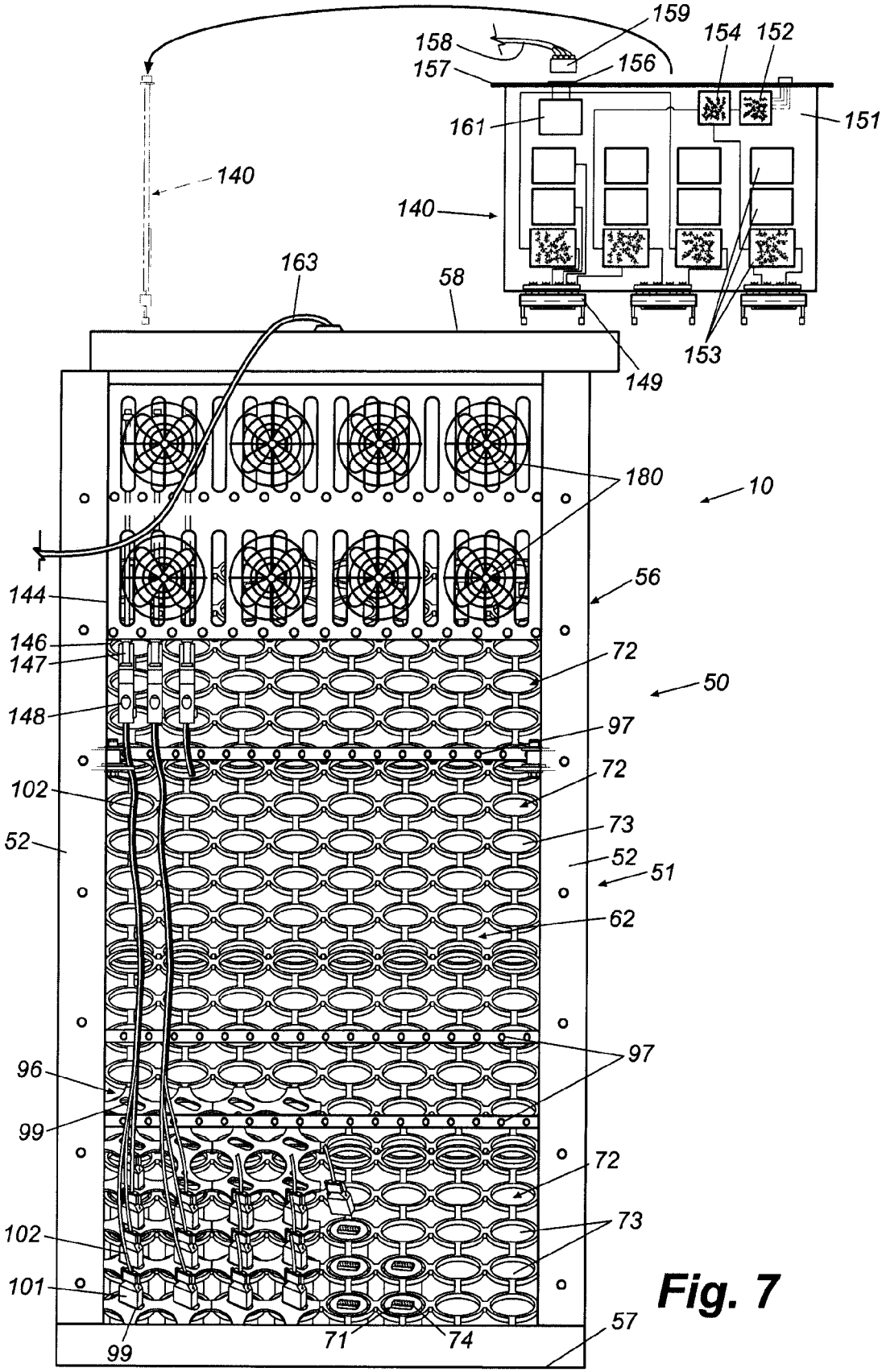
FIG. 7 is a rear view of the yarn feed attachment of FIGS. 1 and 2.

As further illustrated in FIGS. 4A and 7, the rear or distal ends of the drive motors 71 are received and mounted within motor cable mounting plates 96, which are mounted to the yarn feed unit frame 51 and extend along the interior 62 of the housing 56, generally arranged parallel to a corresponding motor mounting plate 72. As indicated in FIG. 7, the motor cable mounting plates 96 generally include a series of recesses 98, generally sized and shaped to receive the rear or distal end 74 of a drive motor 71 therein, and with a slotted opening or aperture 99 formed in each recess 98 through which a cable connector 101 of a motor control cable 102 is received and connects to the rear of the drive motor. As a result, the motors will be releasably mounted to and secured within the unit housing 56 with the connection port (not shown) for each motor being aligned for ease of connection of a control cable 102 thereto.

As FIGS. 1, 2 and 4A illustrate, a series of yarn feed tubes generally are extended along the open interior area 62 (FIGS. 1 and 2) of the yarn feed unit housing 56. Each of the yarn feed tubes 105 generally is formed from a metal such as aluminum, or can be formed from various other types of metals or synthetic materials having reduced frictional coefficients so as to reduce the drag exerted on the yarns passing therethrough. The yarn feed tubes 105 generally extend from an upper or first end 106 adjacent a yarn guide plate 107 mounted to the front face or surface 59 of the housing 56 as shown in FIG. 1, and extend at varying lengths, each terminating at a lower or terminal end 108 adjacent a drive motor 71, as indicated in FIGS. 1 and 4A.

The yarn guide plate 107 (FIG. 1) generally is an upstanding plate, typically formed from a metal such as aluminum, or other similar types of materials and includes a series of guide openings 109 through which the yarns 12 are received, as shown in FIG. 3 and feed into an individual yarn feed tube 105 (FIG. 2) associated with each guide opening 109. As further shown in FIG. 3, tension bars 111 generally are extended through the yarns, with the yarns intertwined about the tension bars 111 in a substantially serpentine path as they are received from the creel (not shown) or similar yarn feed supply so as to maintain tension on the yarns as they are passed or fed into the yarn feed unit to avoid tangling or misfeeding of the yarns.

Figure 4B:
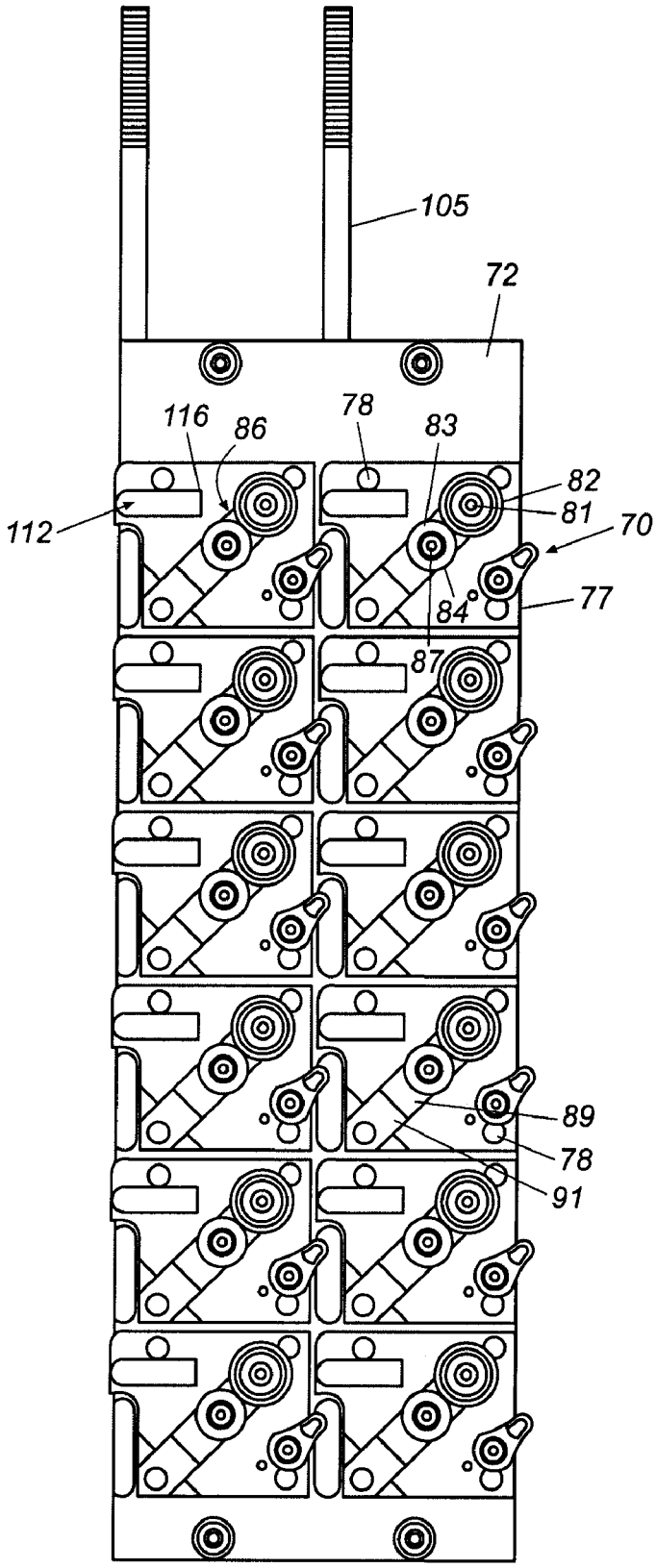
FIG. 4B is a front view illustrating the yarn feed devices of the present invention.

As the yarns exit the terminal ends 108 (FIG. 4A) of the yarn feed tubes 105, they are fed through a yarn feed guide mechanism 112, which directs the yarns toward the pinch area 86 between a drive roll and idler roll for the drive motor associated or assigned to control the feeding of that particular yarn. FIG. 4A illustrates one embodiment of the yarn feed guide mechanism, which includes a substantially L-shaped tube 113 of similar material to the yarn feed tubes 105, and which has a first or receiving end 114 that extends through the face plate 77 of the yarn feed device 70 and a second or exit end 116 that is generally oriented at approximately 90° with respect to the first end 114 and directs the yarn into the pinch area between the drive and idler roll of the yarn feed device as illustrated in FIGS. 3 and 4.

Alternatively, the yarn feed guide mechanism 112 can include a quick connect/disconnect yarn guide 117 as shown in FIG. 5. The quick connect/disconnect yarn guide of 117 generally will include a pair of spaced guide plates 118 mounted on a shaft 119 adjacent the pinch area 86 of the yarn feed device and each of which generally includes a hook or projection 121 on an inwardly facing side thereof. The yarns can be passed between the guide plates 118 and will be engaged and held in place by the hook 121 during feeding. Thereafter, to disconnect a yarn therefrom, the yarn can simply be looped back on itself so that it passes by the hook or projection of the guide plates and can therefore be pulled free of engagement therewith. It will be understood by those skilled in the art that various other yarn feed guide mechanisms also can be used, and further that it is also possible to utilize the yarn feed devices of the present invention without a yarn feed guide mechanism such that the yarns are simply passed through openings 122 formed in the face plates 77 of the yarn feed devices and are fed directly into the pinch area 86 (FIG. 4A) between the drive and idler rolls.

As indicated in FIGS. 1-3, the yarn feed devices 70 at each of the stepped sections defined therealong the front face 59 of the yarn feed unit 50, generally are arranged in sections or groups of yarn feed devices 123, 124, 126, 127, (FIGS. 1 and 2) that are positioned in staggered or overlapped series extending upwardly along the front face of the housing as shown in FIGS. 1 and 2 for ease of access for threading into a replacement of the yarn feed devices. This stepped design also enables the tubes to be mounted and extended in overlapping layered arrangements to enable a more compact design for the yarn feed unit. A series of yarn guides 128 are mounted between each of these sections 123, 124, 126 and 127, with each yarn guide generally including a substantially flat plate 129 attached to and projecting outwardly from the step plates 64 of the frame 51 of the yarn feed unit and having a series of openings or slots 131 formed in spaced groups or sets thereacross. As shown in FIG. 3, the yarns 12 being fed by the yarn feed devices 70 are passed through the openings 131 of the yarn guides 128 to separate and guide the yarns as they are fed into the puller rolls 22 (FIG. 2) for the tufting machine for feeding to the needles 13. In addition, tension bars can be inserted between the yarns 12, which wrap around the tension bars as the yarns are fed from the yarn feed devices so as to help maintain tension and prevent tangling of the yarns as they are fed through the yarn guides.

Figure 6:
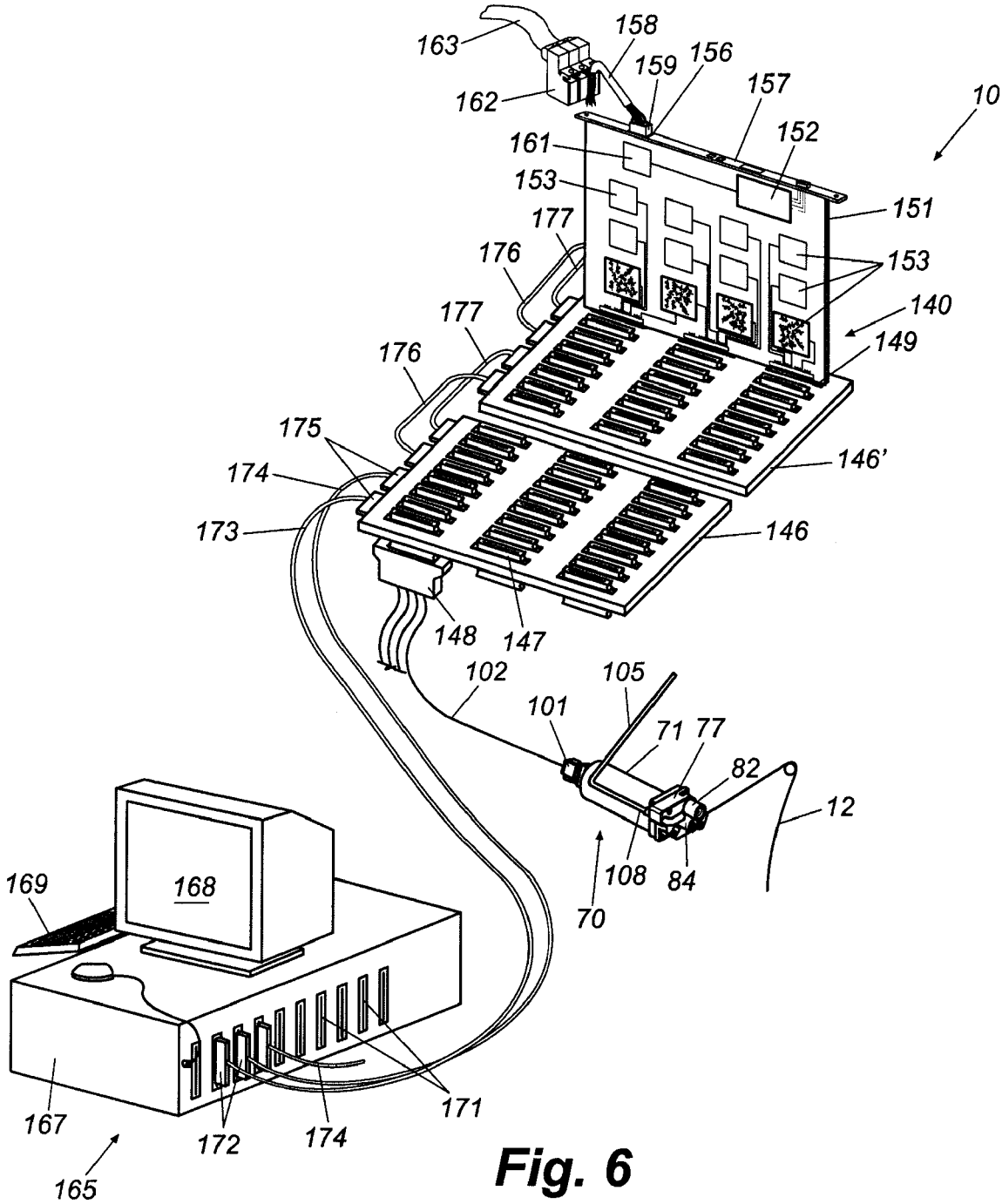
FIG. 6 is a schematic illustration of the connections of the yarn feed controllers to the system controller.

As illustrated in FIGS. 1, 2 and 6, the yarn feed unit 50 of the present invention further includes a series of yarn feed controllers or multiple drive units (MDU's) 140 that are received and removably mounted within a controller cage or support cabinet 141 (FIG. 1) that is mounted within the interior region or area 62 of the housing 56 adjacent the upper end 58 thereof. The controller cage 141 generally is formed from a lightweight, high strength material such as aluminum or other similar metal or synthetic material, and includes side panels 142, front and rear plates 143, 144, and at least one back plane or base 146. As shown in FIG. 1, each of the back planes 146 generally includes spaced series of 64/96 pin DIN 14912 connectors 147 to which mating cable connectors 148 attached to the opposite ends of one or more motor control cables 102 from controller cable connectors 101 can engage and connect to the yarn feed controllers 140. Additionally, the front and rear plates 143 and 144 of the controller cage 141 also generally include a series of slots 149 formed therein for enabling enhanced air flow through the controller cage.

Each of the yarn feed controllers 140 generally includes a controller board 151 that is plugged into a series of connectors 147 along a back plane 146 as illustrated in FIGS. 1, 2, and 6, defining a control module or unit that can be removably mounted within the controller cage. Each yarn feed controller 140 further includes an MDU control processor 152, which typically is a 16-32 bit processor or similar micro controller, such as a Siemens C165 or C167 CR/SR micro controller with about a 20-40 MHz CPU clock speed and low voltage (i.e., approximately 5 volts) power requirements and with 32-128 MB ROM, and with each control processor generally running multiple (i.e., 2) networks. The yarn feed controllers each are mounted on the controller board 151 and communicate with a series of motor controllers or drives 153. The control processors 152 further typically perform diagnostic conditions such as monitoring temperature or other fault conditions occurring on their board 151. Each of the drives or motor controllers 153 generally includes a digital signal processor (DSP), such as an Analog Devices DSP401, ADSP 21XX, or Texas Instruments TMS320 DSP, and typically will control one drive motor 70, although it will be understood that it would also be possible to utilize other controllers or drives that are capable of controlling greater numbers of motors, i.e., 2-12 motors per controller. The motor controllers also monitor internal encoders or other feedback devices of the drive motors 71 under their control and provide feedback to the control processors of the yarn feed controllers.

As a further alternative, the control processor 152 of the yarn feed controller, could directly control a series of motors 71 assigned to a yarn feed controller. In such an embodiment, the yarn feed controllers generally would include, for example, a 1 GHz Pentium 3 or a 2 GHz Pentium 4 processor and with the controller boards having additional systems or devices, such as current sensors, feedback chips to monitor the motor encoders, etc. In addition, as indicated in FIG. 7, a secondary control processor 145, which typically will be a similar type control processor 152, also can be mounted on each controller board and will receive and run the same instructions in parallel with the primary control processor and generally is connected to each of the motor controllers or drives 153 so as to provide redundancy and a backup to ensure enhanced reliability of the yarn feed controllers.

As additionally shown in FIGS. 1, 2, and 6, each of the yarn feed controllers 140 generally includes a series of releasable plug-in connectors 156, which typically are DIN 64 or 96 pin connectors. It will be understood that various other type connectors also can be used. Each of the connectors 156 generally engage a mating 64/96 pin connector 147 of the back plane 146 (FIGS. 1 and 6), which connectors 147 also receive and connect to a mating cable connector 148 to which a series of motor control cables 102 is attached as indicated in FIGS. 1 and 6.

As shown in FIGS. 1 and 6, each cable connector 148 generally includes a 64/96-pin DIN connector that enables the ends of the multiple motor control cables 102, for example, 2-4 cables, to connect to and be distributed from each connector 148. The other ends of the motor control cables 102 extend through the interior of the housing and connect to the individual motors being controlled by the motor controllers as discussed above and as shown in FIG. 2. Each of the motor control cables 102 generally will include approximately thirteen wire leads, including 3 motor wires and a shield, and a series of feedback wires, a voltage or power supply line or wire and a ground, for transmitting power and to communicate drive or operational instructions and motor feedback between the yarn feed motors and their respective motor controllers, although fewer wire leads also can be used.

Additionally, a power input line or cable 158 having a connector 159 will connect to each power input connector 156 for each yarn feed controller 140 in order to provide power, generally about 20V AC, which is passed through a diode bridge 161 on each controller board 151 that converts the incoming AC power to DC power for operation of the yarn feed controllers and for powering the yarn feed motors 71. The diode bridge 161 also generally has a heat sink to promote dissipation of heat/power management. As shown in FIGS. 1, 2, and 6, each power line 158 generally is connected to a power distribution block 162, which in turn is connected to a power supply (not shown) by a main power line 163. This enables the simpler assembly and connection of the motor drive units motor to the power supply without requiring individual power lines to be run to each motor, and further enables simpler and easier maintenance and/or replacement of components such as drive motors 71 or a yarn feed controller 140, by disconnecting the power to that particular yarn feed controller and thus to a particular series of motors, without having to disrupt the power supply to the remaining components of the yarn feed unit.

As indicated in FIG. 2, the yarn feed control system 10 of the present invention generally includes a system controller 165 that can include workstation 166 (shown in FIG. 2) having a PC type computer 167 typically with a monitor 168 and user input 169, such as a keyboard, mouse, drawing pad, key pad or similar input mechanism. In addition, the monitor 168 could include a touch screen to enable operator input therethrough. The computer 167 of the system controller 165 generally will have a Pentium 3 or Pentium 4 processor, video or monitor connection, Ethernet connection, and a series of PCI slots 171 (FIG. 6) that receive plug-in network cards or processors 172. Typically, the system controller computer will include approximately 1-8 network cards 172, each of which runs two networks for transmitting control/ratio change information to and receiving motor feedback information from each of the control processors of the yarn feed controllers. Each of the network cards 172 generally is a dedicated 16-32 bit processor capable of handling multiple network communications, typically via CAN bus type physical communications networks, having input/output capabilities. Examples of such processors could include Siemens C165 or C167CR/SR micro controllers. Other network systems that could be used include USB and/or firewall or other high serial bus networks.

The system controllers typically will be electrically connected to the yarn feed controllers by a first, feedback or real-time network channel via cable 173 (FIG. 6) and at least one second, gearing change or control information network cable 174, which connect to the network cards or plug-in board 172 at the system controller. It will also be understood that the real-time, feedback and the control information networks also can be run on the same, single network channel or cable. Network cables 173 and 174 generally are RS485 multi-drop twisted pair CAN bus derivative megabyte cables, over which the information is passed between the control processors of the yarn feed controllers and the network card/processors at the computer 167 of the system controller 165.

Additionally, the network cables 173 and 174 typically will include 9 pin or similar multi-pin connectors 175 that will plug into the network cards and into the back planes. As illustrated in FIG. 6, the first or real-time network cable 173 is connected to a first one of the network cards/processors 172 at one end and is connected at its opposite end to a first one of the back planes 146. This real-time network channel provides a network connection between the system controller 165 and yarn feed controllers 140, over which current, real-time information, such as feedback from the motor encoders and other time sensitive or critical control information or feedback is communicated from the control processors of the yarn feed controllers to the system controller. Multiple gearing change or pattern control information network cables 174 generally will be connected to additional ones of the network cards 172, with there typically being at least one pattern control information network channel supporting up to approximately 192-384 motors, and with each network card being able to support at least two pattern control information network channels/cables as indicated in FIG. 6. Thus, for example, for controlling up to 1200 motors, seven control information network cables 174, one real-time or feedback network cable 173, and five network cards 172 typically would be used, with there being four network cards for the pattern control information network cables 174 and one network card for the real-time or feedback network cable 173.

As further illustrated in FIG. 6, each yarn feed unit of the yarn feed control system of the present invention typically will include multiple back planes 146, each of which will typically support approximately 8-16 yarn feed controllers or MDUs 140. Each of the feedback planes 146 generally is positioned or aligned in series as indicated at 146 and 146'. The feedback or real-time and control information networks further will be communicated across the back planes 146-146' via daisy chain type connections of feedback or real-time and control information network cables, as indicated at 176 and 177, respectively. As a result, such network connections can be established between the back planes during construction of the yarn feed unit, without requiring additional extensive cabling to be installed and connected between the system controller and yarn feed controllers when the unit is installed in the field.

The system controller generally will communicate with each of the yarn feed controllers via the networks, with feedback reports being provided from the yarn feed controllers to the system controller over the first, feedback or real-time network (via network cable 173) at approximately 1 msec intervals so as to provide a substantially constant stream of information/feedback regarding the drive motors 71. Pattern control instructions or motor gearing/ratio change information for causing the motor controllers 152 to increase or decrease the speed of the drive motors 71 and thus change the rate of feed of the yarns as needed to produce the desired pattern step(s), are sent to the control processors 152 of the yarn feed controllers 140 over the pattern control information network cables 174 in bursts of information generally sent at intervals of approximately 13-15 msec or less. In addition, the yarn feed motors generally will be electronically geared to the main shaft of the tufting machine at desired buffered gear ratios that will vary depending upon the yarns being fed and the rates of feed of such yarns.

It is generally preferred that the system controller typically will be able to update all buffered gear ratios for each of the motors (up to approximately 2048 motors) in less than about 13-15 msec through the issuance of network commands to each of the motor controllers without lost counts or lost motion during such gear changes. Further, the yarn feed control system 10 generally will send gearing ratios or change information at about 1-3 times per revolution of the drive motors. The system controller further generally will be electronically connected to the tufting machine controller 26, as indicated in FIG. 1, so as to receive pattern and feedback information from the other operative drive elements of tufting machine, such as feedback from the main shaft encoder 33 (FIG. 2), needle bar shifting mechanisms, etc., although it is also possible for the system controller 165 to receive feedback directly from the main shaft encoder, etc. of the tufting machine as indicated by cable connector 178 shown in phantom lines in FIG. 2.

The system controller will process the feedback information from the tufting machine and from the motor controllers 152, received at essentially 1 msec intervals, and will issue gearing ratio change or motor control instructions or commands in clusters or pockets sent over network cable(s) 174 to the yarn feed controllers 140. The processors 152 of the yearn feed controllers, acting as routers, will break down the clusters of information and send each motor controller connected thereto its specific control instructions. In response, the motor controllers 152 control their associated drive motors for varying the feeding of the individual yarns to each of the respective needles as needed, depending upon the pattern, step, or sequence being run.

The system controller can also receive pattern information, such as pattern data files stored at the machine controller, or can access or download such pattern data files via a network connection from a network server by downloading the file(s) from a floppy disk or similar recording media directly input at the system controller, or by loading pattern data files stored in the internal memory of the system controller. In addition, the system controller 165 generally will include a real-time operating system set up to be capable of running commonly available Internet protocols such as web browsers, FTP, email, etc., and will have a modem and communication software to enable dialup and system connection to the controller either remotely or via LAN or WAN connections to enable remote access and troubleshooting.

The system controller further can be accessed or connected to the design center computer 40 through such communications package or system, either remotely or through a LAN/WAN connection to enable patterns or designs saved at the design center itself to be downloaded or transferred to the system controller for operation of the yarn feed unit of the present invention. The system design center computer further generally will have, in addition to drawing or pattern design functions or capabilities, operational controls that allow it to enable or disable the yarn feed motors, change yarn feed parameters, check and clear error conditions, and guide the yarn feed motors. As discussed above, such a design center component, including the ability to draw or program/create patterns also can be provided at the tufting machine controller 26, which can then communicate the programmed pattern instructions to the system controller, or further can be programmed or installed on the system controller itself Thus, the system controller can be provided with design center capability so as to enable an operator to draw and create desired carpet patterns directly at the system controller.

Still further, it will be understood by those skilled in the art that while the yarn feed unit system controller has been disclosed as including a separate work station, it is also possible to include the system controller with the tufting machine controller 26, as part of an overall operational control system, with the control functions of the yarn feed unit system controller and/or the tufting machine controller being programmed and operated by such an operational control system with a single operator interface. As a result, the present invention also enables direct control of the yarn feed unit by the tufting machine control so as to provide a single workstation or control system for controlling all aspects of the tufting machine and yarn feed unit, which can also include the ability to design, create and program desired carpet patterns directly at the tufting machine, which pattern instructions will be carried out by the tufting machine controller as part of the overall control of the operation of the tufting machine and the yarn feed unit to produce the desired pattern.

As shown in FIGS. 1, 2 and 7, a series of fans 180 further generally are mounted along the rear plate 144 of the controller cage 141 and help draw an airflow through the controller cage and further aid in the dissipation of heat. The design of the yarn feed unit, with side openings and open interior, further aids in the drawing of an air flow into and through the yarn feed unit for more rapid and efficient dissipation of heat to protect the electronic components of the yarn feed control system. The housing of the yarn feed unit further generally has shock mounting for the controller cage and can include vibration dampeners to reduce vibration and its potential effects on the yarn feed controllers and yarn feed devices. The yarn feed controller boards further are generally received within the cage and fit or are guided into position along guide rails for ease of installation.

As generally illustrated in FIGS. 1 and 2, the yarn feed control system 10 of the present invention can be manufactured as a self-contained, substantially standardized, pre-fabricated unit or yarn feed attachment 50 having a predetermined number of yarn feed devices and yarn fed controllers mounted therein and with the motor controller cables connected between the yarn feed controllers and the associated drive motors of the yarn feed devices. The yarn feed unit can be manufactured, tested and shipped separately from a tufting machine 11 to which it will be mounted for feeding individual or single ends of yarn to corresponding needles of the tufting machine. Typically, a series of yarn feed units of the yarn feed control system 10 of the present invention can be selected or otherwise removed from an inventory of yarn feed units and installed on the frame 16 of a tufting machine 11, with the attachment of mounting brackets 64 (FIG. 1) to the frame of the tufting machine. One or more yarn feed units generally will be selected depending upon the number of needles or individual yarn ends to be controlled. The yarn feed units will be mounted across the width of the tufting machine and can be mounted on both the input and output sides of the tufting machine for providing front, back, or both front and back yarn feed control.

Once the unit(s) are installed on the tufting machine, a real-time network cable 173 (FIGS. 2 and 6) will be connected to the system controller 165 or directly to a tufting machine controller a first one of the back plane 146 to which the unit system controllers 140 are mounted to enable the communication of real-time feedback information regarding the operation of drive motors 71 to the system controllers. At least one control information network cable 174 also is connected to the system controller and the back plane 146 for transmitting pattern control or gearing/ratio change instructions and information to the system controllers for controlling the operation of the yarn feed unit(s), without requiring the installation and/or direct connection of control cabling from the system controller to each of the motor controllers or drives for the drive motors. Typically, the number of control information network cables 174 used will depend on the number of yarn feed units in use. Thereafter, the yarn feed control system 10 can simply be powered up, such as by pressing a control start button at the system controller 165, or if the system controller 165 is part of the tufting machine controller 26 (FIG. 2), by powering up the tufting machine controller or machine control system.

Figure 8:
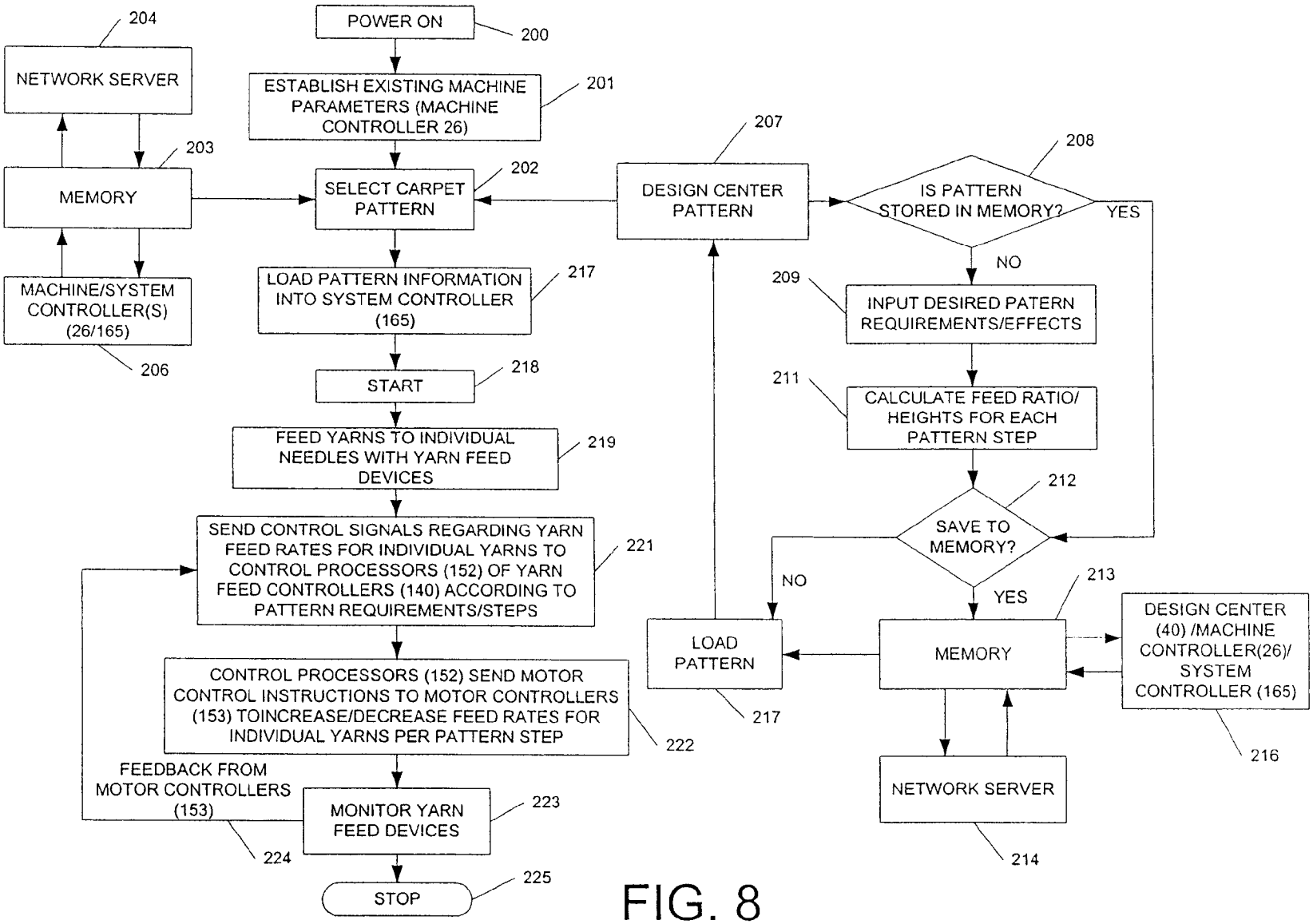
FIG. 8 is a flow chart generally illustrating the operation of the yarn feed system of the present invention.

In operation of the yarn feed control system 10 of the present invention, which is illustrated generally in FIG. 8, in an initial step 200, the system controller 165 (FIGS. 2 and 6) of the yarn feed controller system 10 of the present invention, and the tufting machine controller 26 are powered on, after which the tufting machine controller will proceed to establish existing machine parameters such as reciprocation of the needles, backing feed, bed rail height, etc., as indicated at 201 (FIG. 8). As shown at 202, the operator will then select a carpet pattern to be run on the tufting machine. This carpet pattern can be selected from memory 203, either stored at a network server, indicated at 204, from which a carpet pattern data file will be downloaded to internal memory of the tufting machine or system controller, or can be stored directly in memory at the tufting machine controller or system controller as indicated at 206.

Alternatively, the pattern or pattern data file can be created at a design center, shown at step 207, and downloaded or otherwise inputted into the tufting machine or system controller at the tufting machine. The design center, as discussed above, can include a stand-alone or remote design center 40 (FIG. 2) or the tufting machine and/or system controllers 26 and 165, respectively, can be provided with a design center component or functionality, including design center software and tools for drawing or creating patterns such as a drawing tablet, a mouse, and other input devices. For patterns created and/or downloaded from a design center as shown at 207 (FIG. 8), the designer or operator can select to either design a new pattern or call-up a pattern previously stored in memory in step 208. If the operator or designer wishes to design a new pattern, as shown at 209, the designer will input desired pattern requirements or effects, such as by drawing out a desired pattern, which can be illustrated on a design center monitor, and/or by programming in various carpet pattern parameters, including pile height, stitch rate, shift or step sequences, etc.

As shown at 211, the design center will calculate yarn feed rates and/or ratios, and pile heights for each pattern step, and will create a pattern data file, which is then saved to memory at 212. As indicated at 213, the memory can include a memory or storage on a network server, 214, or can include internal memory at the design center computer, or at the tufting machine controller or system controller if such controllers includes a design center component within the memory of the tufting machine and system control as indicated at 216. At step 212, the operator or designer also as the option of not saving the pattern data file to memory, but rather simply loading the designed pattern, as indicated at 117, and either transferring or downloading the pattern from the design center to the tufting machine or system controller, as shown at step 207. Additionally, if the desired pattern is stored in memory at the design center as indicated at 208, the pattern simply can be recalled from memory 213 and thereafter loaded, step 217, for transfer and/or operation of the tufting machine or system controllers.

After the desired carpet pattern has been selected as indicated at 202, the pattern information typically is then loaded into the system controller 165 (FIG. 2) of the yarn feed control system 10. The operator then starts the operation of the yarn feed control system, as indicated at 218 in FIG. 7, whereupon the yarn feed devices 70 (FIG. 2) will pull and feed yarns from a creel (not shown) at varying rates according to the programmed pattern information, which yarns are fed to puller rolls 22, which in turn, feed the yarns directly to the individual needles 13 of the tufting machine 11. As shown at 219 (FIG. 7), the system controller will send pattern control instructions or signals regarding yarn feed rates or motor gearing/feed that are ratioed to the rotation of the main drive shaft of the tufting machine, individual yarns to the yarn feed controllers 140 (FIG. 2) via control information network cables 174 at approximately 13-15 msec intervals. Such pattern control instructions or signals/information are received by the control processors 152, which route specific pattern control instructions to the motor controllers or drives 153, which accordingly cause their drive motors 71 to increase or decrease the feeding of the yarns 12, as indicated at 221 (FIG. 7), as required for pattern step.

As further indicated at 223, the motor controllers monitor each of the drive motors under their control and provide substantially real-time feedback information 224 to the system controller, which is further receiving control and/or position information regarding the operation of the main shaft and the backing feed from the tufting machine controller that is monitoring the main shaft and backing feed encoders, needle bar shift mechanism(s) and other operative elements of the tufting machine. This feedback information is used by the system controller to increase or decrease the feed rates for individual yarns, as needed for each upcoming pattern step for the formation of the desired or programmed carpet pattern. After the pattern has been completed, the operation of the yarn feed control system generally will be halted or powered off, as indicated in 225.

Figure 9A:
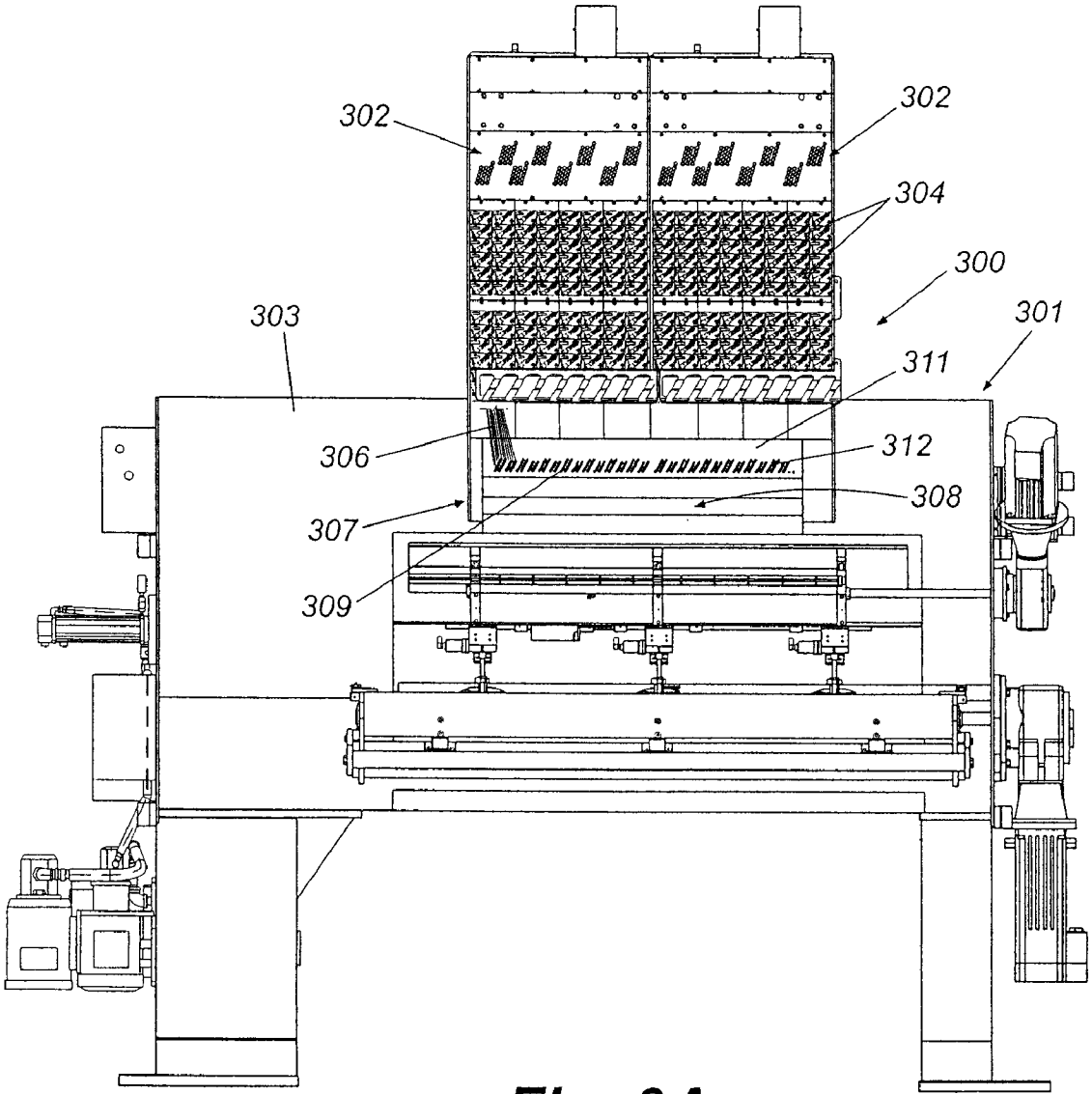
FIG. 9A is a side elevational view of an additional embodiment of the yarn feed system of the present invention including tube bank sections.
Figure 9B:
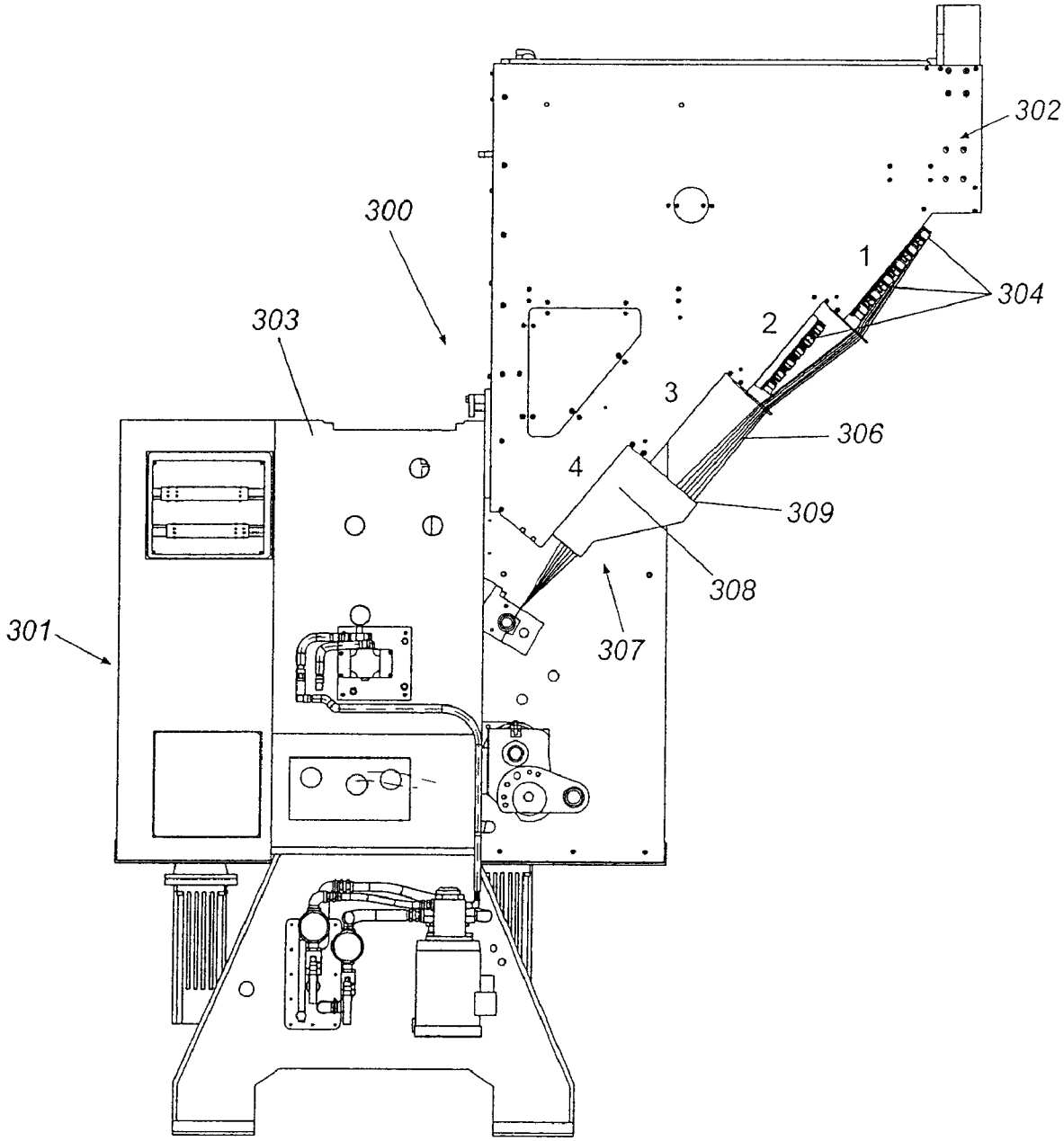
FIG. 9B is an end view of the embodiment of the yarn feed system of FIG. 9A.
Figure 10A:
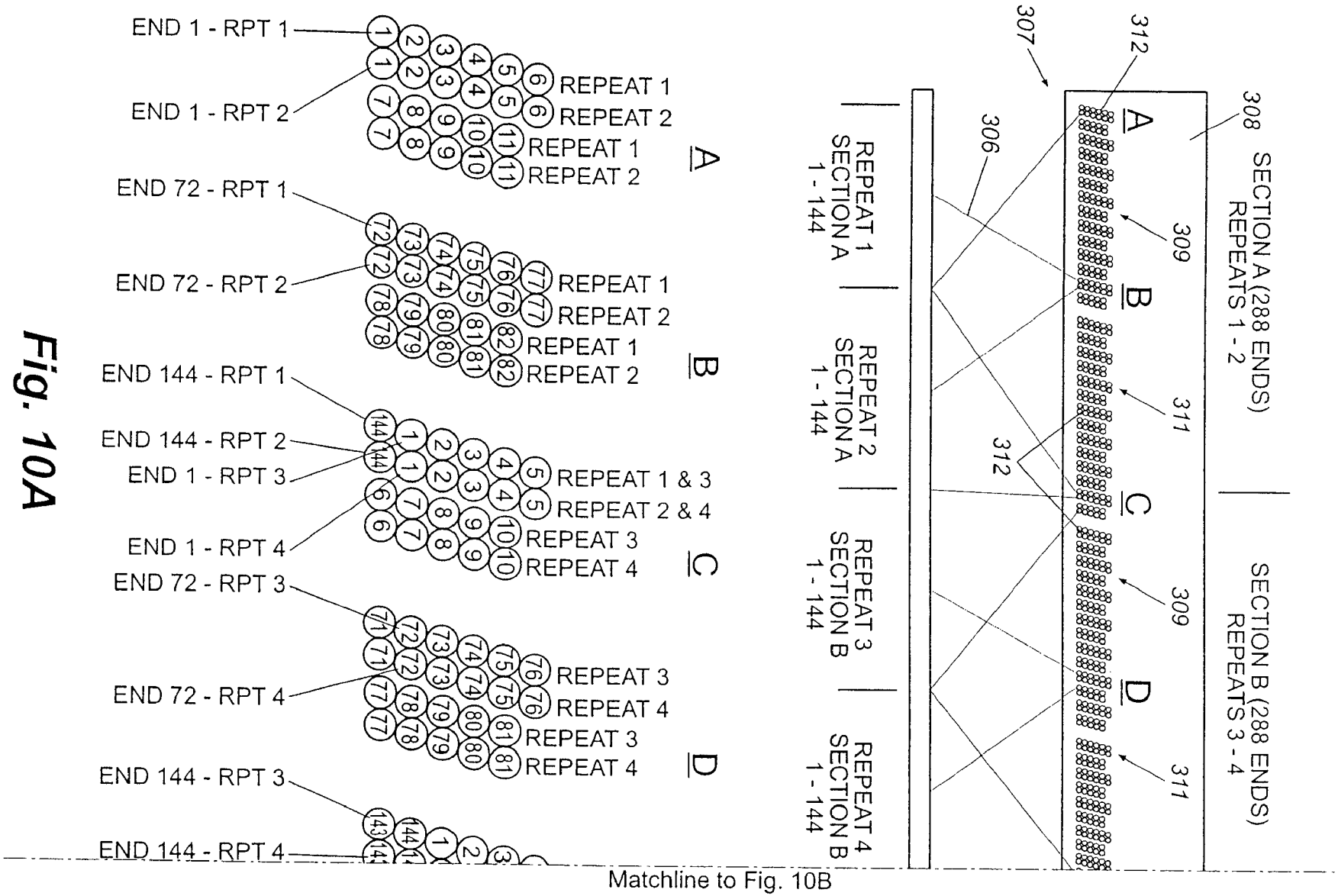
FIG. 10 is a schematic illustration of the multiple tube bank sections for the yarn feed system of FIGS. 9A and 9B.
Figure 10B:
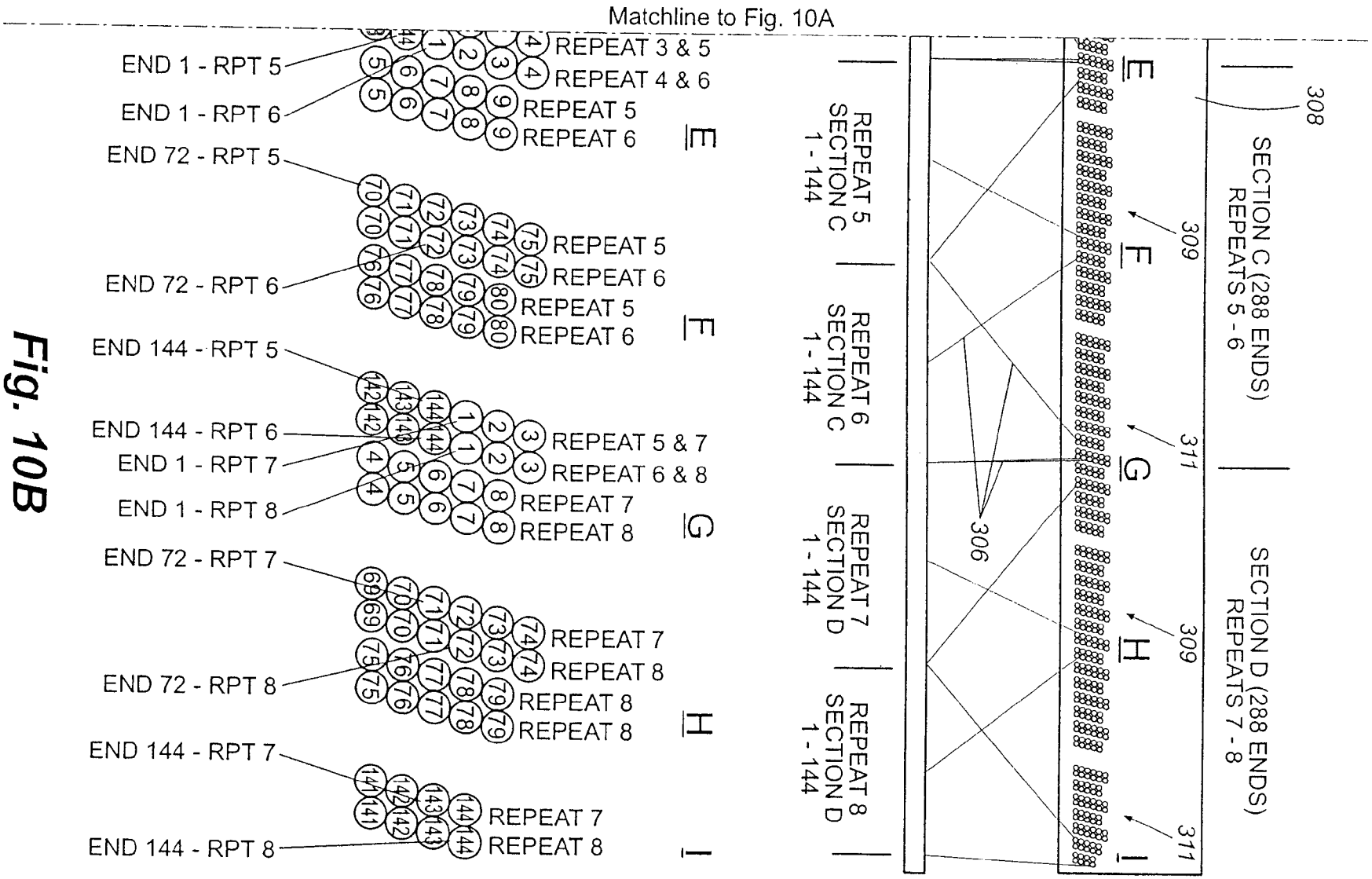

An additional embodiment of the yarn feed system 300 for a tufting machine 301 is generally illustrated in FIGS. 9A-10. In this embodiment, the yarn feed system 300 includes a series of yarn feed units 302 (FIGS. 9A-9B), which generally have a construction and operate as discussed above with reference to FIGS. 1-8. Each of the yarn feed units is a substantially self-contained unit or assembly that is mounted along the frame 303 of the tufting machine 301 and each includes a series of yarn feed devices 304 for feeding a series of yarns 306 to selected needles of the tufting machine as shown in FIGS. 9A and 9B. Similar to the yarn feed devices 70 discussed above with reference to FIGS. 1-4A and 5, the yarn feed devices 304 of the present embodiment generally each include a drive motor, drive roll and an idler roll and are controlled by a motor controller that receives pattern control information from the system control, which can be a separate controller or part of the overall tufting machine control system. For purposes of illustration and not limitation, a pair of yarn feed units 302 are shown mounted to the frame of the tufting machine in FIG. 9A, although it will be understood by those skilled in the art that varying numbers of yarn feed units can be mounted in series along both sides of the tufting machine as needed or desired, depending upon the number of needles and pattern effects desired to be run by the tufting machine.

As shown in FIGS. 9A and 10, a pattern yarn feed distribution device 307 is mounted along the frame of the tufting machine, along a lower portion or section of each of the yarn feed units 302. The yarn feed distribution device can include a yarn feed distribution device or system as is substantially disclosed in U.S. Pat. No. 5,983,815, the disclosure of which is incorporated herein by reference. The yarn feed distribution device 307 generally includes a series of tube banks 308 as indicated in FIGS. 9A and 9B. As shown in FIG. 10, each of the tube banks 308 is associated with one of the yarn feed units, and is divided or arranged into two or more tube bank sections or repeats, such as generally indicated at 309 and 311. Each of the tube bank sections can be a "straight tube bank," or can be "scrambled" to enhance the yarn feed therethrough and minimize yarn lag, etc. The tube bank sections 309/311 also include a series of feed tubes 312, through which the yarns 306 (FIG. 9A) are received and fed, and which typically are formed from aluminum, plastic or other durable, reduced friction materials to ensure that the yarns will pass easily therethrough.

As indicated in FIGS. 9A and 9B, the yarns from one or more of the yarn feed devices 304 of each of the yarn feed units 302 are fed to the tubes 312 of a tube bank 308 associated with that particular yarn feed unit. Each of the yarn feed devices 304 generally will feed at least two or more yarns to separate tubes of the associated tube bank 308, with one yarn being fed for each repeat or station 309 or 311 of the associated tube bank 308, as indicated in FIGS. 9A and 10. Thus, in operation, each of the yarn feed devices of yarn feed unit in this embodiment generally can be supplied with two or more yarns, which will be fed to selected yarn feed tubes of each section or repeat 309 or 311 of the tube banks 308 for each yarn feed unit. Typically, the repeats will be at approximately standard 18-24 inch widths, although various other pattern repeat sizes also can be utilized as necessary or desired.

With this arrangement or embodiment of the yarn feed system 300 of the present invention, the number of yarn feed devices 304 and thus the number of yarn feed units 302 required for feeding yarns to each of the needles of the tufting machine can be substantially reduced, as each yarn feed device 304 can be used to feed two or more yarns to selected needles, thus reducing the number of yarn feed units required for feeding the yarns necessary for running various desired pattern effects. The use of the multiple tube bank sections of the yarn feed distribution device 307 further generally helps minimize the problems of yarn elasticity and yarn lag when feeding yarns through the needles from each of the yarn feed units so as to promote enhanced pattern definition occurring in the graphic patterns produced across the face of a tufted article being produced by the tufting machine.

The present invention accordingly enables the control of individual or single ends of yarns to each of the needles of a tufting machine to enable enhanced control of the feeding of the yarns to provide greater precision and to enable a greater variety and variation in designing and producing carpet patterns. The yarn feed control system of the present invention further enables the manufacture of substantially standardized yarn feed units or attachments that can be manufactured with a desired number of yarn feed devices that can be manufactured and tested separately from a tufting machine, and thus can be maintained in inventory for mounting on a tufting machine as needed, without requiring a custom manufacture of the yarn feed units. Multiple yarn feed units can be selected from inventory and mounted on a tufting machine and thereafter connected to a system controller or to the tufting machine controller itself without requiring extensive cabling to be run and electrical connections made and tested in the field, for enhanced reliability and efficiency of manufacture and installation of such units on a tufting machine. The design of the yarn feed control system of the present invention further enables relatively quick and efficient expansion and removal and replacement of yarn feed devices, yarn feed controllers, or other operative components as needed for ease of manufacturing and maintaining the system.

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A tufting machine for forming patterned tufted articles, comprising:

at least one reciprocating needle bar carrying a series of spaced needles;

backing feed rolls for feeding a backing material through the tufting machine;

a series of driven yarn feed devices, each including a drive motor and a feed roll formed from a rubber material for gripping and feeding yarns to the needles driven by its drive motor, wherein a majority of the yarn feed devices receive at least two yarns per feed roll and feed each of the yarns to selected ones of the needles so as to form at least one pattern repeat across the backing material, and wherein there are at least approximately one-half the number of yarn feed devices as there are needles of the tufting machine; and a control system for controlling feeding of the yarns by the yarn feed devices to form a desired tufted pattern.

2. The tufting machine of claim 1 and further comprising a yarn distribution device having at least one tube bank section, and wherein a majority of the yarn feed devices feeds at least two yarns each through separate tubes of the at least one of tube bank section to the needles.

3. The tufting machine of claim 2 and wherein at least a portion of the yarn feed tubes of said tube bank are scrambled.

4. The tufting machine of claim 1 and further comprises a series of yarn feed controllers each controlling one or more of the yarn feed devices.

5. The tufting machine of claim 1 and further comprising a mirror repeat tube bank having a series of tubes for feeding the yarns to their selected needles.

6. The tufting machine of claim 1 and further comprising a series of yarn feed devices each feeding a single yarn to a selected needle.

* * * * *